US007281296B2

(12) United States Patent
Strauser

(10) Patent No.: US 7,281,296 B2
(45) Date of Patent: Oct. 16, 2007

(54) DEBRIS COLLECTION SYSTEMS, VEHICLES, AND METHODS

(75) Inventor: Daniel P. Strauser, Elgin, IL (US)

(73) Assignee: Federal Signal Corporation, Oak Brook, IL (US)

( * ) Notice: Subject to any disclaimer, the term of this patent is extended or adjusted under 35 U.S.C. 154(b) by 335 days.

(21) Appl. No.: 10/504,645

(22) PCT Filed: Feb. 13, 2003

(86) PCT No.: PCT/US03/10301

§ 371 (c)(1),
(2), (4) Date: Nov. 15, 2004

(87) PCT Pub. No.: WO03/069071

PCT Pub. Date: Aug. 21, 2003

(65) Prior Publication Data

US 2005/0060834 A1 Mar. 24, 2005

Related U.S. Application Data

(63) Continuation-in-part of application No. 10/074,777, filed on Feb. 13, 2002, now Pat. No. 6,854,157.

(51) Int. Cl.
*E01H 1/08* (2006.01)

(52) U.S. Cl. ..... 15/348; 15/340.3; 15/340.4; 15/349

(58) Field of Classification Search ..... None

See application file for complete search history.

(56) References Cited

U.S. PATENT DOCUMENTS 880,124 A 2/1908 Butler (Continued)

FOREIGN PATENT DOCUMENTS

EP 0 578 442 B1 5/1997

(Continued)

OTHER PUBLICATIONS

Web Site: http://www.tymco.com/moddst.html, TYMCO Model DST-6®—Dustless Sweeping Technology, pp. 1-2, printed Mar. 12, 2002.

(Continued)

*Primary Examiner*—David Redding
(74) *Attorney, Agent, or Firm*—Leydig, Voit & Mayer, Ltd.

(57) ABSTRACT

The invention provides debris collection devices that include a debris contacting mechanism, a debris transport mechanism that is configured to receive debris moved by the debris contacting mechanism at an inlet and move such debris towards a debris storage compartment, and a filter and vacuum assembly. The filter and vacuum assembly includes an inlet disposed downstream of the inlet of the transport mechanism and upstream of the debris storage compartment, relative to the path of transported debris. In operation, the filter and vacuum assembly generate a primary air flow that draws the airborne particles into the inlet of the transport mechanism, along a path proximate to the transport mechanism, into the inlet of the filter and vacuum assembly and though a filter located within the filter and vacuum assembly without generating a substantial airflow through the storage compartment. Related debris collection and processing systems and methods also are provided.

10 Claims, 13 Drawing Sheets

U.S. PATENT DOCUMENTS

| | | | |
|---|---|---|---|
| 1,610,119 | A | 12/1926 | Butler |
| 3,604,051 | A | 9/1971 | Wendel et al. |
| 4,006,511 | A | 2/1977 | Larsen |
| 4,206,530 | A | 6/1980 | Kroll et al. |
| 4,258,451 | A | 3/1981 | Sommerfeld |
| 4,345,353 | A | 8/1982 | Sommerfeld |
| 4,557,739 | A | 12/1985 | Fortman et al. |
| 4,716,621 | A | 1/1988 | Zoni |
| 4,754,521 | A | 7/1988 | Zoni |
| 4,787,923 | A | 11/1988 | Fleigle et al. |
| 4,819,676 | A | 4/1989 | Blehert et al. |
| 4,825,500 | A | 5/1989 | Basham et al. |
| 4,846,297 | A | 7/1989 | Field et al. |
| 4,862,548 | A | 9/1989 | Sergio |
| 4,884,313 | A | 12/1989 | Zoni |
| 4,993,107 | A | 2/1991 | Zoni |
| 5,013,333 | A | 5/1991 | Beaufoy et al. |
| 5,044,043 | A | 9/1991 | Basham et al. |
| 5,054,152 | A | 10/1991 | Hulicsko |
| 5,060,334 | A | 10/1991 | Strauser et al. |
| 5,093,955 | A | 3/1992 | Blehert et al. |
| 5,125,128 | A | 6/1992 | Davis |
| 5,231,725 | A | 8/1993 | Hennessey et al. |
| 5,303,448 | A | 4/1994 | Hennessey et al. |
| 5,802,665 | A | 9/1998 | Knowlton et al. |
| 5,829,094 | A | 11/1998 | Field et al. |
| 5,940,929 | A | 8/1999 | Berg |
| 5,943,733 | A | 8/1999 | Tagliaferri |
| 6,117,200 | A | 9/2000 | Berg et al. |
| 6,161,250 | A | 12/2000 | Young et al. |
| 6,195,836 | B1 | 3/2001 | Vanderlinden |
| 6,195,837 | B1 | 3/2001 | Vanderlinden |

FOREIGN PATENT DOCUMENTS

| | | |
|---|---|---|
| EP | 0 860 554 A2 | 8/1998 |
| EP | 0 970 652 A2 | 1/2000 |
| EP | 0 878 583 B1 | 8/2000 |
| IT | 206218 Z | 7/1987 |

OTHER PUBLICATIONS

BROCHURE: Dulevo 5000 City, Mechanical—Suction, the Dulevo Solution, p 1, not dated.

BROCHURE: Tennant, The New Centurion™ Street Sweeper. The Street Smart Alternative From Tennant, pp. 1-2, not dated.

DEBRIS COLLECTION SYSTEMS, VEHICLES, AND METHODS

CROSS-REFERENCE TO RELATED PATENT APPLICATIONS

This application is a continuation-in-part of U.S. patent application Ser. No. 10/074,777, filed Feb. 13, 2002, now U.S. Pat. No. 6,854,157 the entirety of which is hereby incorporated by reference.

FIELD OF THE INVENTION

This invention pertains to systems for collecting debris, vehicles comprising such systems (e.g., street sweepers), and related methods of handling debris.

BACKGROUND OF THE INVENTION

Motorized debris-collecting devices were first developed in the early 20th century. Since the first motorized street sweeper was put into use in 1914, there have been numerous modifications, improvements, and variations in the design of debris collection devices. U.S. Pat. Nos. 4,206,530, 4,615,070, and 5,943,733, for example, describe debris-collecting vehicles having several common features, including a brush debris collection system, a filter, a hopper for containing collected debris, and a vacuum for moving debris through the vehicles. While somewhat effective for debris collecting, such debris collection systems and vehicles suffer from various limitations that restrict their usefulness in the handling of collected debris. For example, vacuum systems of such devices may cause such devices to be incapable of effectively moving large debris throughout the device (e.g., to the hopper and/or through the filter). As such, the vehicles of the '530, '070, and '733 patents may be incapable of effectively handling larger and/or heavier debris, and the placement of the hopper in such devices is usually restricted to near the debris collection system.

An additional problem associated with the use of many known debris collection devices (particularly, street sweepers) is the need to spray liquid (typically water) during debris collection. The use of water or other liquids can be undesirable, particularly in colder climates where water may freeze forming ice on the cleaned surface. Several "waterless" sweeper systems have been developed in an effort to address these problems. For example, U.S. Pat. Nos. 4,754,521 and 4,884,313 describe sweepers that attempt waterless debris collection. In particular the '521 and '313 patents describe street sweepers comprising a roll brush debris collection system, a vertical paddle-based conveyor belt for delivery of collected debris, and a hopper containing a filtration system. Although capable of substantially waterless debris collection, such debris collection vehicles are often inefficient in the handling of collected debris. For example, the design of these sweepers requires inefficient use of the filter due to its placement in the hopper. The use of a paddle-based vertical conveyor system and non-focused vacuum suction also can cause operational inefficiencies.

For these and other reasons, there is a need for improved and alternative debris collection systems, vehicles incorporating such systems, and methods of debris removal and handling. The invention provides such systems, vehicles, and methods. These and other advantages of the invention, as well as additional inventive features, will be apparent from the description of the invention provided herein.

BRIEF SUMMARY OF THE INVENTION

The invention provides several types of debris collection and processing devices, systems, vehicles comprising such systems, and related methods of collecting and/or processing debris. For example, in one aspect the invention provides a debris collection device that includes, among other features, a debris contacting mechanism, a debris transport mechanism being configured to receive debris moved by said debris contacting mechanism at an inlet and move said debris towards a debris storage compartment, and a filter and vacuum assembly including an inlet disposed downstream of the inlet of the transport mechanism and upstream of the debris storage compartment relative to the path of transported debris. In operation, the filter and vacuum assembly generate a primary air flow that draws the airborne particles into the inlet of the transport mechanism, along a path proximate to the transport mechanism, into the inlet of the filter and vacuum assembly and through a filter located within the filter and vacuum assembly without generating a substantial air-flow through the storage compartment.

In a more particular exemplary aspect, the invention provides a debris collection device comprising a vehicle with a plurality of wheels, at least one wheel being maneuverable by a selectively operable steering mechanism and at least one wheel providing propulsion, a debris contacting mechanism, which contacts debris on a surface from which debris are to be collected and moves the collected debris in a direction which is substantially the same as the direction of forward movement of the vehicle, and a debris transport mechanism. The debris transport mechanism includes an inlet located proximal to the debris contacting mechanism, which is configured to receive debris moved through the device by the debris contacting mechanism. The debris transport mechanism is deposed on an incline. Collected debris received through said inlet are deposited upon the debris transport mechanism such that gravity and friction will maintain the debris (i.e., at least some portion of the collected debris that are deposited onto or into the transport system) within and/or upon the transport mechanism without the assistance of a scoop or a cleat for a sufficient amount of time to facilitate transportation. A driving mechanism connected to the debris transport mechanism imparts movement to the transport mechanism thereby moving the debris towards a debris storage compartment. Operation of the debris contacting mechanism generates airborne particles in the area proximate to the inlet of said transport mechanism. The operation of the device prevents at least some of the airborne particles from dispersing into the surrounding air or environment. The device further includes a filter and vacuum assembly including an inlet disposed downstream of the inlet of said transport mechanism and upstream of the debris storage compartment relative to the path of transported debris. In operation, the filter and vacuum assembly generate a primary airflow that draws the airborne particles into the inlet of the transport mechanism, along a path proximate to the transport mechanism, and into the inlet of the filter and vacuum assembly without generating a significant air flow through the storage compartment.

In yet another exemplary sense, the invention provides a debris collection vehicle having, among other features, a selectively operable steering mechanism and motor, each of which is operably linked to at least one of the vehicle's wheels, a debris collection system, a collected debris inlet that receives debris from the debris collection system, an at least partially enclosed mechanical debris transport system comprising a continuously operated or selectively operable drive system, a debris storage compartment, a vacuum, an exhaust, and a filter housing. In such aspects, the filter housing is separate from and does not directly communicate with the storage compartment (in terms of airflow or mechanical debris transport) and includes a filter housing inlet and at least one replaceable filter. During debris collection, the debris collection system delivers debris from a target surface area to the collected debris inlet wherein the collected debris is received by the enclosed mechanical transport system. Also in such aspects, the enclosed mechanical transport system delivers the collected debris to the storage compartment. The vacuum desirably creates a suction force that acts on the mechanical transport system (and surrounding chamber or housing) and thereby delivers at least a portion of the collected debris in, on, and/or around the mechanical transport system upstream of the storage compartment (with respect to the transit of debris in or on the mechanical transport system) through the filter housing inlet, into the filter housing, and into contact with the filter therein.

The replaceable filter and vacuum typically are characterized by the ability to bind debris particles of about 10-80 microns in size, or even (and preferably) about 2.5-100 microns in size. As such, the debris collection vehicle is advantageously (and preferably) capable of debris collection without the use of water or other liquid dust suppressant. Alternatively or additionally, such debris collection vehicles can be equipped with a system for spraying water or another suitable liquid to suppress dust particulates during debris collection. Preferred debris collection vehicles provided by the invention have more particular and additional advantageous characteristics, such as the inclusion of a tortuous airflow path positioned between the filter and portion of the mechanical transport system approximately adjacent to the filter housing (with respect to the flow of air from the mechanical transport system's housing into the filter housing and to the filter).

In another more particular aspect, the invention provides a debris collection vehicle that includes a mechanical debris collection system comprising a cylindrical, rotatable, and selectively surface-engaging pickup broom, a conveyor system housing, a collected debris inlet that receives debris from the main broom and directs the debris to the conveyor system housing, a sloping continuous conveyor system that is positioned in the conveyor system housing and which comprises a conveyor belt and selectively operable drive system, a debris storage hopper having an internal volume of at least about 1.5 cubic yards (e.g., about 2-7 cubic yards) a filter housing, a vacuum-generating fan system, and an exhaust. The filter housing desirably is separated from and not in direct airflow or physical debris delivery communication with the hopper and includes a filter housing inlet that is directed towards a portion of the conveyor belt upstream of the hopper, and a replaceable multiple-barrier cloth filter having a minimum filter capacity of about 10 microns or less. In this aspect, the filter is attached to a shaker or agitator that, when operated, causes debris bound by or retained in the filter to be released into the filter housing (and which desirably pass back through the filter housing inlet to the mechanical transport system for delivery to the hopper). The filter system can desirably be further characterized by the inclusion of a tortuous airflow path, which typically is formed by one or more airflow re-directing impermeable barriers or turns, positioned between the filter housing inlet and the filter, with respect to the airflow path within the filter housing created by the vacuum's suction force. The vacuum-generating fan system preferably is positioned such that operation of the fan system generates a suction force which draws air from a portion of the conveyor belt into the filter housing inlet, through the tortuous path, and into contact with the filter, with sufficient pneumatic force/velocity that debris particles of about 10-100 microns in size contact and are bound by (retained in) the filter. Similar to the above-described vehicle, the filter housing favorably is positioned upstream of the hopper with respect to the flow of debris in or on the conveyor belt, and, in operation, the pickup broom delivers debris to the collected debris inlet wherein collected debris is received by the conveyor belt, and the operation of conveyor system causes the conveyor belt to deliver the collected debris towards the debris storage hopper. The vacuum generated by the fan system preferably is directed by the orientation of the filter housing inlet to a portion of the conveyor system housing located upstream of the filter housing inlet (with respect to the flow of debris in or on the conveyor belt), such that most of the suction force in the conveyor system housing is applied upstream of the storage compartment, and the majority of the collected debris (by weight) does not enter the filter housing.

The invention further provides systems for handling debris comprising similar elements (a mechanical transport system, debris storage compartment, and filter housing, including a debris-retaining filter) in similar and alternative configurations, as well as methods of collecting and/or handling debris by use of such systems and vehicles. Such systems and methods are described in detail, along with additional debris collection vehicles and devices, in the following Detailed Description of the Invention.

DETAILED DESCRIPTION OF THE INVENTION

Figure 1:
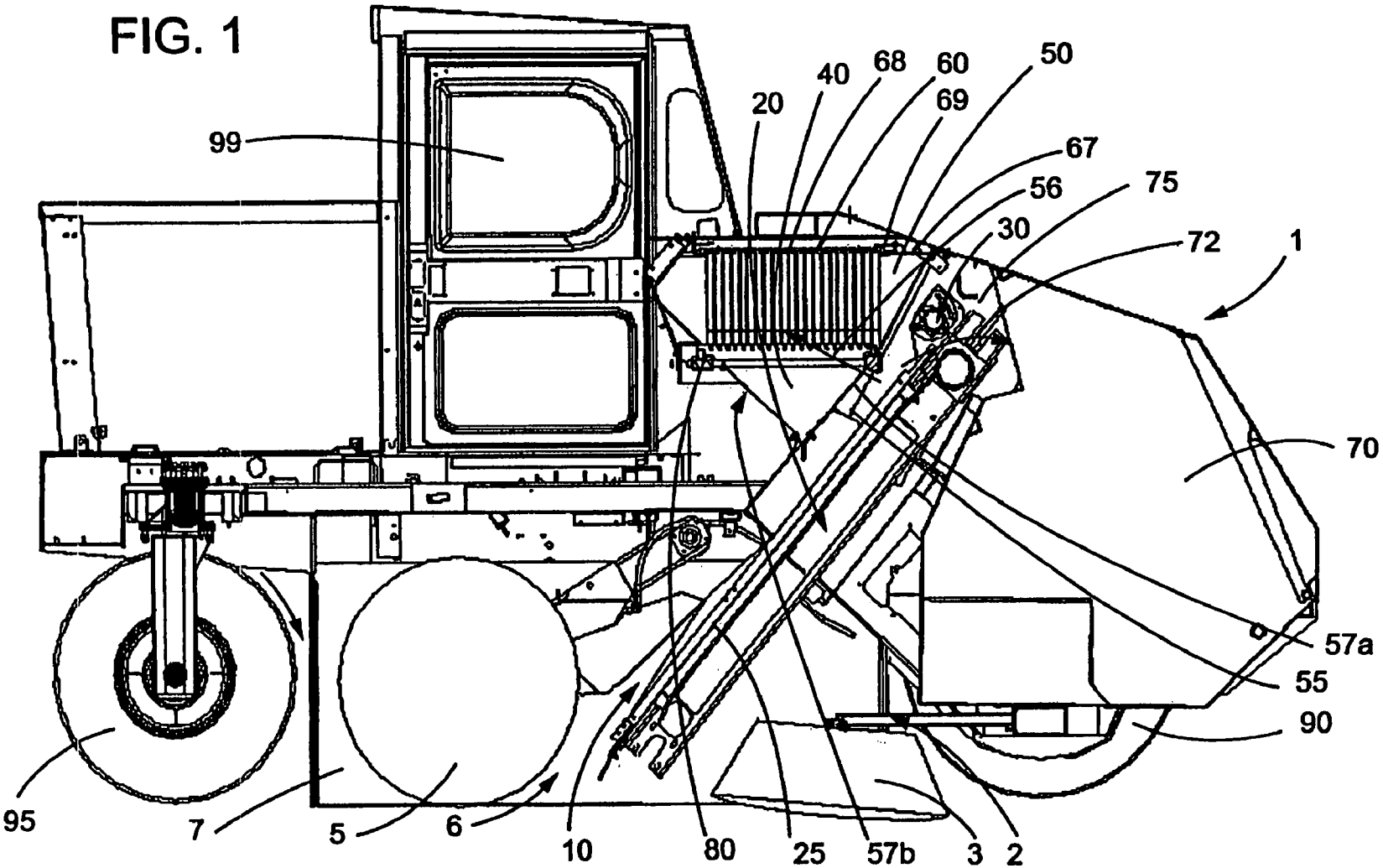
FIG. 1 provides a side cutaway view of an exemplary debris-collecting vehicle of the invention comprising a dual rear wheel configuration and a one-way flow storage compartment.

The invention provides alternative and improved systems for debris collection and handling ("debris processing"), vehicles comprising such systems, and related methods of collecting and handling debris. While several aspects of the invention are separately described herein, it will be understood that any aspect of any system, vehicle, device, or method described herein can be combined with any other aspect of the invention, unless otherwise stated or clearly contradicted by context.

In one aspect, among others, the invention provides a system for handling debris in a debris collection apparatus that includes a filter housing, a filter housing inlet, and a filter housing exhaust; a vacuum; a mechanical transport system; and a storage compartment. In operation, the mechanical transport system of the exemplary system delivers debris to the storage compartment, and the vacuum generates a directed suction force that, outside of the filter housing, is substantially limited to a portion of the mechanical transport system upstream of the storage compartment (with respect to the flow of debris in or on the mechanical transport system). The suction force delivers at least a portion of the debris in the discrete area through the inlet and into the filter housing, such that the filter filters the portion of debris. The system can be further characterized in that the filter housing and storage compartment are not in direct communication with one another.

As the systems of the invention are designed and used for the collection of debris, the debris-carrying portion in any particular system often is at least substantially isolated from the environment, and, as such, can be described as a "closed system." However, it will be appreciated that at various points, such as at the airflow exhaust, a debris collection inlet, and at points where debris are removed from the system, the system may be exposed to the environment. In preferred systems, the overall design permits the system to be readily incorporated in a larger debris-collecting apparatus, such as a street sweeper or debris sweeper for cleaning industrial areas such as cement plants, foundries, paper mills, pulp manufacturing facilities, power generation plants, and the like. Examples of such sweepers are further described herein. Thus, for example, the system can form a unit or module that can be inserted within the chassis of any suitable street sweeper. More typically, the system is a component or module built in conjunction with for incorporation in a specific debris collection vehicle, preferred examples of which are described below.

The system comprises a debris transport system, which typically is a substantially enclosed mechanical debris transport system (in contrast to, e.g., a vacuum transport system). The system can comprise any suitable debris transport system. The preferred mechanical transport system can be any mechanized system that is at least substantially enclosed and suitable for physically delivering debris from one location to another within the enclosed portion, such that the transported debris in or on the system is not released into the environment during transport. Typically and preferably (although not necessarily), the mechanical transport system consists of or comprises a substantially enclosed conveyor system. Any type of conveyor system suitable for the transport of debris can be included in the system in this respect. For example, the conveyor system can comprise a paddle and chain conveyor system or a squeegee-type conveyor (such conveyor systems are known in the art). Alternatively and preferably, the conveyor system comprises a smooth-surfaced or ridged-surfaced belt conveyor. The conveyor or other mechanical transport can be in any suitable orientation for delivering debris to a position where the vacuum's can acts on a portion thereof, depositing debris carried by the transport suction force into the storage compartment, and performing these functions without releasing the substantial majority of the transported debris. Thus, conveyor system can include any suitable number of conveyor belts (e.g., 2, 3, or more belts) or other interconnected components.

A preferred debris transport system comprises or consists of a sloping and continuous jam-free conveyor system, rather than, for example, a horizontal paddle system. The sloping and continuous conveyor can desirably be fitted with or include a plurality of raised fill-width ridges or cleats for moving large and/or heavy debris. However, in some aspects, the debris transport system can be characterized as an inclined system that is capable of delivering at least some of the debris deposited in or on the system to the storage compartment without the assistance of a scoop, cleat, paddle, or similar structure, for a sufficient amount of time to facilitate transportation of the debris to the storage compartment. It should be clear that while capable of such "unassisted" debris transport, such transport systems may nonetheless be fitted with raised cleats or be fitted other suitable transport-facilitating structures for more effective debris transport. In such aspects, some proportion of the collected debris is deposited onto or into the debris transport mechanism in a manner, and the debris transport mechanism is configured, such that gravity and/or friction maintain the debris thereon and/or therein for a sufficient period of time until either a scoop, cleat, or the like will support the debris or until at least a substantial proportion of the debris are deposited into the storage compartment. The devices, vehicles, and systems of the invention can include such a debris transport system alone or in combination with any of the other elements of the preferred devices, vehicles, and systems of the invention described herein. The debris transport system is selectively operable, but in some aspects also can be continuously operated (e.g., automatically operated) upon the occurrence certain conditions (e.g., the operation of the mechanical debris collection system and/or vacuum). Particular examples of preferred debris transport systems are discussed further herein.

The system also includes a filter and vacuum assembly or system. In preferred systems, the vacuum primarily acts in an area before the point where the transport system feeds debris into the storage compartment, such that a portion of the debris in and around (i.e., proximate to) the area are removed from the debris transport system and delivered airborne to the filter housing by way of a primary airflow. In other words, the vacuum suction force in such a system is substantially greater in an area of the debris transport system away from and upstream of the storage compartment than at the point where the transport system deposits most of the debris into the storage compartment. In such a configuration, the storage compartment can be described as "downstream" of the point where the vacuum primarily acts on the conveyor or transport, as the majority of the debris in the system are transported past that point and into the storage compartment. Indeed, the configuration of the preferred system can be described with respect to the positioning of its components as either "upstream" or "downstream" in relation to one or more other components along a particular debris transport pathway.

The preferred storage compartment can be any compartment suitable for receiving and storing debris, in a manner that the stored debris is not released into the environment therefrom until desired. Typically, a debris-collecting hopper made of a suitable material for incorporation into a debris-collecting vehicle is used as the storage compartment. As such, the storage compartment usually will be made of a sturdy metal or alloy, such as tubular and flat plate steel, stainless steel, and/or heavy gauge steel. Alternatively, lighter materials, such as aluminum, can be used to form the storage compartment. The storage compartment can be formed from any suitable combination of these or other suitable materials. The storage compartment can be of any suitable size. Typically, the storage compartment will comprise a single compartment hopper of at least about 1 cubic yard in volume. For example, a typical debris storage compartment consists of a single compartment hopper about 1.5-10 cubic yards in volume. More typically, such a hopper will have an internal volume of about 2-8 cubic yards. Even more typically, the hopper will have an internal volume of about 3-6 cubic yards. For example, volumes of about 3.5 cubic yards, about 5.5 cubic yards, or about 6.5 cubic yards can be suitable. The storage compartment also can comprise any suitable number of separate compartments (e.g., for collecting separate types of debris). Numerous types of hoppers and other suitable debris storage containers are known. Examples of suitable hopper storage compartments are described in, e.g., U.S. Pat. Nos. 5,251,652, 5,060,334, 4,236,756, 4,222,141, and 4,178,647.

The storage compartment desirably is accessible to the transport system from an enclosed or interior portion of the system as and enclosed on an exterior or exposed side of the system except for any sealable doors or other openings for inspection and dumping. Preferably, the system is designed such that the substantial majority of larger debris introduced into the system are delivered into the storage compartment by the interior access only. Such larger debris is preferably about 100 microns or more in diameter, however, other acceptable ranges include about 150 microns or more, or 200 microns or more, in diameter. Preferably at least about 90-100% of the debris introduced to the storage compartment is delivered to the storage compartment by way of the mechanical transport system. However, in some aspects, a smaller proportion of the collected debris, such as at least about 80%, at least about 70%, at least about 60%, at least about 50%, of the debris introduced to the storage compartment, is delivered by way of the mechanical transport system to the storage compartment. In some systems, the only exterior exposure to the storage compartment is through a door or other selectable entry. In other aspects, the system can include an exterior entry connected to one or more vacuum hoses. For example, the system can include an attachable vacuum hose connected to and in communication with (in terms of airflow) the storage compartment that can be used for manual debris collection. In such systems, the system also desirably a sealable barrier (or "block off plate") for selectively and/or automatically closing off the mechanical transport system at a point upstream of the filter housing inlet, such that the vacuum's suction force is substantially increased through the storage compartment, desirably to a point where at least lighter debris can be collected through the attachable vacuum hose and deposited directly into the storage compartment. In other aspects, the system can comprise one or more at least partially fixed vacuum hose systems that similarly access the exterior side of the housing. In such aspects, the vacuum hose desirably acts in conjunction with one or more side or "gutter" brooms, collecting lighter and smaller debris (e.g., debris particles of about 200 microns or less, or even 100 microns or less in diameter) and delivering such debris to the storage compartment. In such aspects, the substantial majority of the collected particles (and particularly almost all the debris particles of at least about 60 microns, at least about 80 microns, and most typically at least about 100 microns in diameter, or more) are delivered to the storage compartment by the mechanical transport even though the vacuum hose and mechanical transport system may be simultaneously operated. Thus, for example, in such aspects, debris introduced into the hopper by way of the fixed, partially fixed, or flexible vacuum hose makes up less than about 20%, typically less than about 10%, more typically less than about 5%, and, in some instances, even less than about 1% of the total debris introduced into the system (by weight). In systems comprising fixed vacuum hoses in communication with the exterior side of the storage compartment, a larger storage compartment (e.g., a storage compartment of about 5 cubic yards or more in volume) is preferred, as the substantial majority of heavier debris collected through the fixed vacuum hose will usually settle in such a storage compartment rather than traveling further into the interior of the system. Particular examples of debris collection vehicles comprising such systems are described further herein.

In some aspects, the debris storage compartment desirably is capable of being moved away from the rest of the system and/or any vehicle the system is contained in to provide ease of disposal (i.e., dumping or emptying). For example, the storage compartment can be detachably connected to the rest of the system and/or a debris-collecting vehicle the system is associated therewith, such that the storage compartment can be lifted out and/or away from the system/vehicle by powered arms or other moving parts. Such storage compartments facilitate the disposal of collected debris. Examples of this and other types of storage compartments are further described herein.

The preferred system also includes a filter housing, separated from the storage compartment, which includes a filter housing inlet, a filter, and a filter housing exhaust. The filter housing can be any compartment that is suitable for retaining the filter and which is capable of maintaining collected debris isolated from the environment and separated from direct communication with the storage compartment. Preferably, the filter housing and storage compartment are not in direct communication, such that debris cannot directly pass between the two compartments. The filter housing and storage compartment can be separated in any suitable manner. Typically, the portion of the system that houses the mechanical transport system upstream of the filter housing inlet, where the vacuum's suction force typically is maximized, separates the filter housing and the storage compartment.

Preferably, the filter housing is designed such that retention of debris in the compartment, other than debris retained in the filter media, is minimized. For example, a preferred filter housing has a v-shaped bottom portion that directs deposited debris to the filter housing inlet. In such systems, debris particles released from the filter, or which are brought into the filter housing but do not bind to the filter media, move by the force of gravity down the sides of the v-shaped bottom portion to the inlet so that the particles are released from the filter housing and preferably re-deposited into or onto the mechanical transport system, for subsequent delivery to the storage compartment. Thus, in such systems, the substantial majority of debris that contact the filter are retained in the filter or re-deposited onto or into the mechanical transport system housing. Moreover, by increasing the angle of the v-shaped bottom, increasing the space between the filter and the bottom, and/or positioning a tortuous path in the filter housing (as discussed elsewhere herein), the amount of debris in the filter housing that is subject to re-filtration (i.e., contact with the filter more than once) is significantly reduced. Thus, the invention also provides several systems where substantially none of the debris particles in the filter housing contacts the filter more than once. The system can comprise a filter housing of any suitable design for minimizing the amount of unbound debris retained in the filter housing. For example, the bottom portion can be characterized by a single angled/sloping wall that similarly directs deposited debris to the filter housing inlet and back onto or into the mechanical transport system.

Another advantageous aspect of the invention is that it provides debris collection/handling systems and debris collection vehicles comprising such a filtration housing and filter, having characteristics and in a configuration, such that the majority, preferably the substantial majority (e.g., at least about 60%, at least about 75%, at least about 90%, at least about 95%, or more) of the debris that contact the filter is from the debris particles initially entering the filter housing rather than debris released from the filter and retained in the filter housing. More particular examples of filter housings exhibiting the above-described features, and combinations of such features, are described elsewhere herein.

The preferred filter can be any suitable type of filter or filtration system for retaining debris that are introduced into the system and which are light enough to be brought into the filtration compartment by the suction force. The filter can include any suitable filter media or combinations of filter media. Preferably, the filter is capable of waterless debris collection when used in a mechanical debris collection vehicle such as a mechanical broom street sweeper (although, as mentioned above and further described below, the system can be designed for mandatory or optional debris collection with water or another suitable liquid). Typically and preferably, the filter is a multiple pocket or multiple barrier cloth filter. The inclusion of multiple pockets or pleats maximizes the amount of exposed area afforded the filter media, although single barrier filters can be used in some instances. The combination of a suitable vacuum and such filters allows waterless debris collection with acceptable levels of dust control. Desirably, the filter is capable of retaining debris of about 10 microns or less in diameter, as well as larger debris (e.g., particles of about 10-50 microns in diameter or even about 10-100 microns in diameter). Preferably, the filter is capable of retaining debris particulates of about 5 microns or less in size (approximate diameter), and even more preferably about 3 microns or less in size (e.g., about 2.5-3 microns in size), while permitting sufficient flow through the filter and suction force from the vacuum that particulate debris of such size are delivered to the filtration compartment from the mechanical transport system. Such cloth filters can be formed of natural materials or synthetic materials. Desirably, the filter media is water resistant. Suitable synthetic filter media can include, e.g., felts, fiberglass, acrylic, processed polyester materials (e.g., singed polyester), polyamide, polypropylene, and polyvinyl materials. The filter additionally can comprise a filter media directed to filtration of coarser materials, such as one or more media layers. For example, a PTFE membrane can be applied to the filter media to improve filter efficiency. Advantageously, the preferred filter is replaceable, and the system is configured for easy removal and replacement of filters as their useful lifetime expires (although filter life advantageously can be extended by use of an agitation and/or shaker system, as described below, as well as other forms of maintenance). Numerous additional types of filters suitable for collecting such small debris particles are known in the art.

The filter housing desirably also can include one or more screens, grilles, or other debris barriers positioned upstream of the filter (with respect to airflow through the filter housing). Preferably, the filter housing includes a grated metal screen that prevents large but light debris (e.g., leaves, pieces of paper, and the like) from entering the portion of the filter housing that contains the filter. Such a filter housing screen desirably is positioned near or in the filter housing inlet, such that the light but large debris that contact the filter housing screen can be readily released and deposited onto the mechanical transport system for delivery to the storage compartment.

The system also preferably comprises a mechanism for releasing debris from the filter during operation (e.g., an agitator or shaker). Any suitable mechanism can be used for this function. Preferably, the system comprises a shaker linked to a selectively operable motor, which, in operation, shakes or otherwise agitates the filter in one or more directions at a rate and force such that a significant amount of debris are released from the filter into the filter compartment or (preferably) into or onto the mechanical transport system for subsequent delivery to the storage compartment. The shaker or agitator can be selectively and manually operable or linked to an automated control system. Typically, the operation of the vacuum (discussed below) is substantially reduced (such that static pressure in the filter housing is substantially reduced) or entirely halted during the operation of the shaker or agitator. In this respect, the system preferably comprises an electrical control system that automatically stops the operation of the vacuum or suction system during operation of the beater bar or agitator and re-initiates activity of the vacuum/suction system when beater bar/agitator ceases.

The debris collection/handling system further includes a preferred air transport system, such as a vacuum system, which generates a primary airflow that acts on at least a portion of the mechanical transport system (or surrounding area thereof), thereby delivering airborne particles generated by the operation of the debris contacting mechanism and/or at least a portion of the debris in or on the mechanical transport system into the filter housing and to the filter. The flow of air from within the debris transport system and/or debris transport system housing also serves to draw air into the system, device, or vehicle of the invention and, in some aspects, transports particles rendered airborne by operation of the debris contacting mechanism into the enclosed portion of the system, device, or vehicle. The debris collection and handling system of preferred systems and debris collection vehicles provided by the invention can include any suitable type of air transport system. Thus, the air transport system can comprise any suitable number of fans, blowers, or other airflow-generating devices. Commonly and preferably, the air transport system generates a vacuum that generates airflow through desired areas of the system with sufficient velocity and force to capture and carry debris particles (e.g., "fugitive dust") of desired size and/or weight to the filter from desired locations or, in some instances (discussed further below), the storage compartment. Suitable types of vacuum systems include those used in waterless mechanical street sweeper systems known in the art. As such, the discussion of such systems here focuses primarily on desired performance parameters for such systems and particularly advantageous vacuum systems for use in preferred vehicles and systems, as a complete description of other types of potentially suitable systems is not required.

The vacuum is commonly produced by a fan system comprising one or more fans operated by way of a selectively and/or automatically controlled motor. The fan system in such aspects can comprise any suitable combination of fans and motors in any suitable orientation. Typically, the fan system comprises one or more centrifugal fans. Preferred configurations of such fan systems are described in further detail herein.

The operation of the fan system reduces pressure in portions of the system (e.g., the filter housing) such that a suitable suction force is created for capturing and transporting the desired amount and type of debris to desired target locations, usually the filter or the storage compartment. The debris-carrying capacity of the vacuum is dependent on (among other factors) the airflow rate and static pressure in the areas of the system where the vacuum operates. The static pressure and airflow rate are inversely proportional. Generally, the static pressure and airflow are selected to provide sufficient vacuum force and airflow through the system. Preferably, the fan system operates at an airflow speed of about 2,500-4,000 cubic feet per minute (cfm), near the fan. More preferably, an airflow speed of about 3,000 cfm is generated and maintained during operation of the fan system. In operation of most systems, a static pressure of about 10-14 inches of water, more preferably about 11-13 inches of water, is preferred. Such levels of pressure are advantageous in the collection of lighter fugitive debris particles from the mechanical transport system and delivery thereof to the filter.

Static pressure levels of about 15 inches of water or more are typically not desired in normal operation (where the principal purpose of the vacuum is collection of fugitive debris particles from the mechanical transport system). Such undesired vacuum levels may result during normal operation due to debris buildup in the filter media. To address such problems, the system can comprise a pressure monitor that informs an operator to activate the shaker or agitator when static pressure rises above such an undesired level. Alternatively, the system can comprise an integrated or linked pressure monitor and control system that automatically operates the shaker or agitator under such conditions (e.g., the system can include a sensor/control that automatically operates the shaker or agitator when static pressure is above about 15 inches of water). More particular examples of such vacuums and filter systems are further described herein.

As operating conditions vary in some systems, so can the desired level of desired vacuum suction force (e.g., the suction force generated across the filter will usually be lower in normal debris collection/handling operations then when an attachable wandering vacuum hose is used for debris collection directly to the storage compartment). In systems where a portable debris collection device, such as an external vacuum hose is part of the system, the fan system desirably generates a suction force of about 25-45 inches of water, and, more typically, about 30-40 inches of water, during use of the vacuum hose. More particularly, in situations where a wandering vacuum hose and block off plate system are used, static pressure levels of up to about 60 inches of water are acceptable.

In operation, the mechanical debris transport system delivers the substantial majority of the debris in the system to the storage compartment. Thus, for example, where the mechanical transport system is a conveyor belt system, debris are deposited on, in, or are otherwise delivered to, the conveyor belt, and the movement of the conveyor belt delivers the debris towards, and eventually into, the storage compartment. As mentioned above, the vacuum preferably generates a suction force that acts on a portion of the mechanical transport system, drawing air from the channel or passageway in which the mechanical transport system is located, into the filter housing, through the filter, and, preferably, out through an exhaust. The vacuum desirably removes airborne particles in the debris transport system housing (typically, particles rendered airborne by the operation of the debris contacting mechanism) and/or at least a portion of the debris carried by the mechanical transport system into the filtration compartment and into contact with the filter. Thus, the fan system can operate in a regular or low vacuum mode, suitable for collection of debris in the mechanical transport system and delivery thereof to the filter, at a high vacuum mode, suitable for collection of debris from an external source with an attached vacuum hose, or a combined mode, suitable for the collection of debris from the mechanical transport system for delivery to the filter housing and by another route through one or more vacuum hoses directly into the storage compartment.

Preferably, the design of the system is such that the substantial majority of the suction force outside of the filter housing is directed to a limited portion of the mechanical transport system and the proximate surrounding area. Direction of the suction force can be accomplished by any suitable technique. Typically, the design and/or orientation of the filter housing inlet, through which the suction force pulls the debris-laden air into the filtration housing, directs the suction force. Thus, the filter housing inlet is typically a restricted entry facing a portion of the mechanical transport system upstream of the storage compartment.

In preferred systems and debris collection vehicles, a tortuous path or channel separates the filter and the mechanical transport system. The tortuous path or channel can be located in any suitable position. Preferably, the tortuous path is positioned in a portion of the filter housing upstream of the filter (with respect to the path of airflow and debris through the filter housing). Thus, in such systems, particles rendered airborne by operation of the debris contacting mechanism (e.g., the main debris collecting broom) and/or debris light enough to be removed from the mechanical transport system by the suction force, must travel through the tortuous path to reach the filtration compartment. The tortuous path can be formed by any combination of elements that causes the airflow through the relevant portion of the system to have to change direction (e.g., turn or rotate) to a degree that the speed of airflow through the pathway is reduced. Thus, the tortuous path can be any circuitous, indirect, zigzag, nonlinear, and/or twisted flow path, or other type of indirect route. More particular examples of suitable tortuous paths are described in further detail below.

By the orientation, design, and/or positioning of the filter housing inlet, which preferably substantially restricts the area in which the suction force is applied to the mechanical transport system, alone or in combination with inclusion of a tortuous path between the filter and mechanical transport system (physically and/or with respect to airflow into and through the filter housing), the suction force in, around, and/or near the storage compartment (or anywhere substantially upstream of the filter housing inlet) is significantly reduced. As such, the vacuum typically and preferably generates relatively little suction force in the storage compartment (e.g., the system is designed such that the suction force in the storage compartment is preferably less than about 33%, but may be less than about 25%, 20%, 15%, 10%, 5%, or even about 1% of the suction force at the filter housing inlet during normal operation. Normal operation in this sense excludes operation of an external attachable vacuum hose, in which higher levels of suction force in the vacuum typically are desired. In some systems where such a vacuum hose is not included or not in use, there is substantially no suction force in the storage compartment during normal operations (e.g., systems where there is no fixed external vacuum hose operating during normal operations). In most of the systems and vehicles of the invention, there is substantially reduced airflow in the storage compartment as compared to in the filter housing and/or as compared to the portion of the mechanical transport system at the filter housing inlet during normal operations. As a result, airflow in and near the entry to the storage compartment and the associated escape of debris therefrom are significantly reduced, if not entirely eliminated (at least in measurable quantity). In other words, once delivered to the storage compartment, almost none of the stored debris is delivered to the filter housing by application of the suction force, during normal operations. Thus, for example, the components of the system in some aspects are preferably configured and operated such that at least about 60%, or alternatively at least about 75%, 90%, 95%, or even about 99% of the debris matter that enter the filter housing in any aspect of the invention is from the collected debris (debris delivered or introduced to the mechanical transport system), rather than debris from or passing through the storage compartment.

By use of the above-described elements, or combinations thereof, the system can be designed such that less than about 20% of the total collected debris in the system enter the filter housing. Indeed, the design and operation of the system in certain preferred configurations (e.g., systems characterized by the inclusion of a tortuous path between the filter and the portion of the mechanical transport system where debris are removed by the suction force) is such that less than about 10%, less than about 5%, or even less than about 1% of the collected debris enter the filter housing during normal operation. The design of preferred systems incorporated in a typical debris collection vehicle is such that, in a normal job (e.g., collection cycle before collected debris are removed from the storage compartment), the filter housing will normally collect less than about 100, typically less than about 50, and more typically less than about 20 (e.g., about 10, about 5, about 1 or less) pounds of debris. Examples of the particular components of such systems are further described herein.

The system preferably is incorporated into a debris collection vehicle. The preferred debris collection vehicle can be any suitable debris collection vehicle comprising a mechanical debris collection system. Favorably, the preferred debris collection vehicle is a motorized vehicle suitable for street sweeping and/or industrial area sweeping. The various components of the systems described above can be combined with any suitable components of such mechanical sweepers. The invention further provides debris collection vehicles having novel designs and features that improve the operation of such systems. As such, the several types of unique mechanical sweeping vehicles are provided by the invention, in addition to the above-described debris collection and handling systems.

With respect to such debris collection vehicles, the invention provides, for example, a debris collection vehicle that includes a plurality of wheels, a selectively operable steering mechanism and engine, each of which are operably linked to at least one of the wheels, a mechanical debris collection system, a collected debris inlet that receives debris from the debris collection system, an at least partially enclosed mechanical debris transport system comprising a continuously operated or selectively operable drive system, a debris storage compartment, a vacuum, and a filter housing comprising a filtration housing inlet, a filter, and a filter housing exhaust. When the preferred vehicle is used to collect debris, the debris collection system collects debris from the environment (typically the surface of a road or industrial area) and transmits the debris to the collected debris inlet where the debris is received by the enclosed mechanical transport system (which preferably is a sloping and continuous conveyor system). The enclosed mechanical transport system delivers the collected debris to the storage compartment. The vacuum preferably delivers at least a portion of the debris in the transport system from an area upstream of the storage compartment through the filtration compartment inlet, into the filtration compartment, and causes the removed debris to be filtered by the filter. Similar to the above-described systems of the invention, the filtration compartment typically and preferably is separate from, and does not directly communicate with, the debris storage compartment.

The preferred debris collection vehicle can operate by any suitable mode of transport. Thus, the vehicles of the invention can include any suitable type and number of wheels (or other transport system supports, e.g., treads), steering mechanism/system, and motor. Suitable types of such components are known in the art, and have been incorporated into known street sweepers and other industrial debris collection vehicles. The components of the above-described system (e.g., the filter, storage compartment, and vacuum) can be incorporated in the preferred vehicle with these vehicular components in any suitable configuration. Particularly preferred configurations are further described below.

The preferred debris collection vehicle includes a mechanical debris collection system, which includes or consists of a debris contacting mechanism (i.e., a device that contacts debris on a surface from which the debris are to be collected and/or cleared and delivers at least some of the contacted debris into the device, system, or vehicle of the invention). The preferred mechanical debris collection system typically includes one or more brushes or brooms that are capable of delivering debris from a surface into the vehicle, such that the debris is captured by and retained in or on the mechanical transport system. In preferred vehicles, the debris collection system comprises or consists of a main central transverse rotating roller brush or central roller broom that engages the surface and delivers debris directly to the collected debris inlet and into or onto the debris transport system by a rotating sweeping motion. Usually, in such vehicles, the width of the main broom (from vehicle side-to-side) at least one half the width of the debris collection vehicle. The main broom engages the surface and rotates at a desired speed and direction, in an orientation and manner similar to the rotation of the vehicle's wheels, such that a portion of the main broom is in contact with the surface at any given time in the operation of the debris collection system. Usually, the main broom rotates in the direction opposite of the forward wheel direction of the vehicle. Preferably, the assembly comprising the main broom is moveable, such that the main broom selectively engages the surface (rather than being in constant contact). The main broom can be of any suitable size, shape, and composition. Typically, the main broom will be fitted with a number of durable, and preferably replaceable, bristles, which can be made of any durable material suitable for debris collection (e.g., polyurethane, polypropylene, or steel wire). The bristles are desirably water tolerant. The main broom usually and preferably is at least partially enclosed in an area or housing exposed to the interior of the vehicle, which also can form the debris collection area.

The debris collection area is the area where collected debris is transmitted into the interior of the vehicle and/or system from the debris collection system. The debris collection area can be in the form of any suitable, at least partially enclosed, area and/or structure that is permissive for the transmission of debris from the main broom or other debris collection system to the conveyor or other mechanical transport system. In preferred aspects, the debris collection system comprises a narrowing, or v-shaped structure or chute, which directs the debris from the width of the main broom to a narrower area in which the bottom of the conveyor system is located. The chute and any housing/covering for the main broom and/or gutter brooms (if included—examples of which are further discussed below) preferably include a flexible bottom portion (e.g., a masticated rubber portion) that is suitable for coming into contact with a road or other hard surface. Preferably, the chute covers at least the portion of the main broom that propels debris into the preferred debris collection vehicle. In this sense, the chute also reduces the amount of airborne debris generated during debris collection.

As suggested above, preferred mechanical debris collection systems also can include one or more "gutter" brooms that assist in debris collection. The name of such brooms derives from the ability of common types of such peripheral debris collection brooms to flex and conform to sweeping areas while in use. Debris collection systems comprising such brooms are known, and the vehicle can comprise any suitable type and/or combination of gutter brooms positioned at any suitable part of the vehicle (e.g., the front, right side, or both sides). The gutter brooms are desirably capable of selectively engaging the surface. In operation, a gutter broom guides debris from the periphery of the vehicle to the main broom for delivery to the debris collection inlet and mechanical transport system. The bottom portion of the gutter broom commonly is fully in contact with the surface during use. The gutter brooms and the main broom usually operate at speeds of 70-200 RPM, although any suitable rotation speed can be used for either type of broom. Broom operation can be powered by a mechanical or hydraulic motor and positioning sweep system.

The mechanical debris collection system preferably is a "waterless" debris collection system. A "waterless" debris collection system is any system that can operate at acceptable dust control levels without the use of water or other liquid. For example, debris collection vehicles comprising multiple barrier cloth filters and having a suction force characterized by a static pressure of at least about 5 inches of water column are usually capable of operating without the use of water or other dust-suppressing liquid while maintaining a suitable degree of dust suppression during debris collection. Although preferred debris collection vehicles desirably include a debris collection system that can operate in a waterless or liquid-free mode, some debris collection vehicles of the invention also or alternatively can include a liquid dust suppression system, examples of which are known in the art. In debris collection vehicles that contain such a water-based or other liquid-based dust control system, the vehicle typically additionally comprises a spraying system comprised of a series of nozzles or other outlets for surface spraying of stored water or other liquid dust suppressant over the debris to be collected as well as a pump and liquid storage tank(s). Certain preferred vehicles also comprise a separate liquid tank for use in cleanup of system components (e.g., by controlled and/or automatic spray down of components of the vehicle, such as spray down cleanup of a conveyor belt system of the invention when not in use). The debris collection system in waterless debris collection vehicles and systems of the invention can be designed such that such vehicles can collect a measurable amount of debris of about 10 microns or less, and more preferably about 3 microns or less (e.g., about 2.5 microns) in size within a normal operating period (e.g., about 1 hour, about 4 hours, or about 8 hours or debris collection—or any other period before stored debris are removed from the storage compartment).

As mentioned above, certain debris collection vehicles can comprise a debris handling and storage system that comprises one or more portable debris collection devices, such as an attachable and, manually operable vacuum hose and/or one or more at least partially fixed vacuum hoses, which directly deliver debris into the storage compartment by way of the vacuum's suction force. In vehicles comprising one or more attachable vacuum hoses, the storage compartment preferably includes a sealable access that engages each attachable vacuum hose (e.g., an orifice surrounded by an annular ring which engages the hose). Such debris collection vehicles also preferably comprise a barrier or closure that is engaged and which closes off the upstream portion of the mechanical transport system (i.e., the end located between the filter having inlet and debris collection inlet), such that vacuum pressure is increased across the top portion of the storage compartment. An attachable wandering vacuum hose usually is operated without the simultaneous operation of the mechanical transport system, typically while the vehicle is stationary, and at higher vacuum pressures, as described above. In operation of the attachable vacuum hose, the operator directs the flexible hose to the desired target area and targeted light debris is brought therefrom into the vacuum hose by the vacuum's suction force, through the exterior sealable access of the storage compartment, and is deposited directly into the storage compartment. Heavier and/or larger debris typically settle in the interior of the storage compartment, as the vacuum force usually is not strong enough to deliver such debris across the length of the storage compartment near the top of the compartment where the airflow is generated. In operation of such a wandering vacuum hose system, lighter debris may be carried into the filter compartment and engage the filter. Air brought into the device through the attachable vacuum hose passes through the filter and out through the normal vehicle exhaust.

At least in some instances, particularly where the vehicle comprises one or more gutter brooms to aid in debris gathering, inclusion of one or more at least partially fixed vacuum hose systems is preferred. In debris collection vehicles comprising such systems, one or more fixed hose portions are preferably affixed to or near, and are in communication with, the storage compartment. The at least partially fixed vacuum hose can be in the form of an entirely fixed, and rigid assembly, but, more typically, will comprise a flexible hose portion that moves in connection with the gutter broom assembly to which it is attached and/or communicates with. The suction force of the vacuum in such instances preferably is raised to a level high enough such that a sufficient suction force is applied across the top level of the storage compartment as well as in the portion of the mechanical transport system passageway upstream of the filter inlet. As such, particulate debris is brought into the vacuum hose or hoses and directly deposited into the storage compartment (i.e., by such particulate debris settling out of the airflow traveling across the top of the storage compartment). Relatively light/small debris (e.g., debris of less than about 100 microns, less than about 50 microns, less than about 10 microns, and even about 2.5 microns in diameter) may be carried through the storage compartment and to the filter compartment where they desirably engage the filter. In contrast to the use of a wandering attachable vacuum hose, the operation of such at least partially fixed vacuum hose systems typically coincides with the operation of the mechanical transport system, as the vacuum system in such vehicles and systems acts both on debris in the mechanical transport system as well as through the external hoses (although the majority of the debris carried by the suction force still originate from the mechanical transport system). The at least partially fixed vacuum hoses are usually and preferably directed to areas where gutter brooms operate, such that particulates that are too small and/or light to be efficiently delivered to the main broom by the gutter broom, and/or that are rendered airborne by operation of the gutter brooms, are collected by the external vacuum hoses, thereby reducing the amount of dust generated during gutter broom operation. Other similar portable debris collection devices can similarly be configured for delivering debris directly into the storage compartment by such operations of the vacuum and filter system of the invention.

As discussed above, the vehicle can have any suitable design. "Three-Wheeled" vehicles, similar to the Elgin Pelican® line, of commercial sweepers and regular four-wheeled vehicles, similar to the Elgin Eagle® line of sweepers and other known commercial transport vehicles, are preferred types of debris collection vehicle designs. In the preferred "three-wheeled" design, a real dual wheel guide wheel is operatively linked to the vehicle's steering mechanism. Such debris collection vehicles are capable of outstanding maneuverability compared to more conventional four-wheeled vehicles and can achieve speeds up to about 20 miles per hour (MPH). Such vehicles are commonly equipped with a variable height front dump hopper debris storage compartment.

In other aspects, four-wheeled vehicles are preferred. Such preferred four-wheel debris collection vehicles are usually capable of moving a larger load of debris and traveling at relatively higher speeds between jobs. For example, a preferred four-wheeled vehicle of the invention can include a hopper having a debris-carrying capacity of about 5-7 cubic yards and can achieve speeds of up to 55 miles per hour when the debris collection system is not in operation.

The debris collection vehicle and system of the invention includes an exhaust for releasing the filtered air from the vehicle into the environment. Thus, the preferred exhaust is positioned downstream of the filter with respect to the flow of filtered air through the filter and out of the vehicle/system. Any suitable type of exhaust can be used for such purposes. Preferably, the exhausted air is diffused as much as possible before release. To accomplish this, the preferred exhaust desirably includes a number of separated outlets, such as a grille or screen, and the airflow path between the filter and the exhaust is maximized and/or characterized by the inclusion of a tortuous airflow path, such as the airflow paths described herein with respect to the optional tortuous path placed between the filter and the mechanical transport system.

In the preferred debris vehicles of the invention, the components of the debris collection system are arranged and operated such that typically less than about 33%, preferably less than about 20%, more preferably less than about 10%, and even more preferably less than about 5% (e.g., about 2-4%), or even about 1% or less of the of the debris collected by the vehicle (whether by the mechanical debris collection system alone or in combination with a vacuum hose system) enters the filter housing. Also or alternatively in preferred debris collection vehicles of the invention, the components of the debris collection system are configured and operated such that less than about 33%, preferably less than about 20%, more preferably less than about 10%, and even more preferably less than about 5% (e.g., about 2-4%), or even less (e.g., about 1% or less) of the debris that enters the filter housing passes through the storage compartment beforehand.

The debris handling system incorporated in the debris collection vehicle can include any of the above-described features associated with the system of the invention. For example, a preferred debris collection vehicle includes a tortuous path positioned between the point where the majority of debris is removed from the mechanical transport system and/or mechanical transport system housing and before the filter (with respect to airflow from the mechanical transport system housing into and through the filter housing). Also or alternatively, the positioning and/or design of the filter housing inlet can direct the vacuum's suction force, such that the vacuum generates a directed suction force that is substantially limited to a portion of the mechanical transport system upstream of the storage compartment. As discussed above, with the inclusion of the tortuous path and direction of the vacuum's suction force, a vacuum that provides a sufficient pneumatic force for collecting debris particles of about 3-100 microns in diameter from a portion of the mechanical transport system and mechanical transport system housing can remarkably generate substantially no suction force in the storage compartment. Debris collection vehicles having such characteristics are a preferred aspect of the invention. Also preferably, the filter housing can be designed (e.g., comprises a steep angled, v-shape bottom portion) such that debris particles that contact the filter are either retained in the filter media or are re-deposited onto the mechanical transport system and preferably delivered thereafter to the storage compartment.

In another exemplary aspect the invention provides a preferred debris collection vehicle comprising a plurality of wheels, a selectively operable steering mechanism and engine, each of which are operably linked to at least one of the wheels, a mechanical debris collection system which (favorably in combination with the other features of the vehicle, is favorably capable of waterless debris collection), a collected debris inlet that receives debris from the debris collection system, an enclosed mechanical debris transport system comprising a continuously operated or selectively operable drive system, a debris storage compartment, a vacuum, and a filter housing comprising a filter housing inlet, a filter, and a filter housing exhaust. In the operation of such a debris collection vehicle, the mechanical debris collection system delivers debris to the collected debris inlet and into or onto mechanical transport system. The mechanical debris transport system subsequently delivers the collected debris to the storage compartment. The vacuum desirably generates a directed suction force that is substantially limited to a portion of the mechanical transport system and surrounding area thereof, which is located away from and upstream of the storage compartment, such that at least a portion of the debris carried by the mechanical transport system, particles rendered airborne by operation of the debris contacting mechanism, or both are filtered by the filter and substantially no debris (e.g., only a trace amount or even no measurable amount) upstream of the limited portion is delivered to the filtration compartment.

In yet another aspect, the invention provides a preferred debris collection vehicle that includes a plurality of wheels, a selectively operable steering mechanism and motor, each of which are operably linked to at least one of the wheels, a mechanical (and preferably debris collection system, a collected debris inlet that receives debris collected by the debris collection system, an enclosed mechanical debris transport system comprising a continuously operated or selectively operable drive system, a debris storage compartment, a vacuum, and a filter housing (or "filtration compartment") that included a filter housing inlet, a filter, and an exhaust. In the normal operation of the preferred vehicle, the mechanical debris collection system delivers debris to the collected debris inlet where the collected debris is received by the enclosed mechanical transport system, the enclosed mechanical transport system delivers collected debris to the storage compartment, and the vacuum delivers at least a portion of the debris in the transport system, particles rendered airborne by operation of the debris contacting mechanism, or both, positioned upstream of the storage compartment through the filter housing inlet to the filter housing such that the portion of the collected debris and/or airborne particulates contact the filter, and substantially all of the debris in the portion and/or the airborne particulates are either retained in the filter or re-deposited onto or into the mechanical transport system and preferably thereafter delivered to the storage compartment.

In yet even another aspect, the invention provides a preferred debris collection vehicle that includes a plurality of wheels, a selectively operable steering mechanism and motor, each of which are operably linked to at least one of the wheels, a mechanical (and desirably waterless) debris collection system, a collected debris inlet that receives debris collected by the debris collection system, an enclosed mechanical debris transport system comprising a continuously operated or selectively operable drive system, a debris storage compartment, a vacuum, and a filter housing comprising a filtration compartment inlet, a filter, and an exhaust. In the normal operation of such a preferred debris collection vehicle, the mechanical debris collection system delivers debris to the collected debris inlet where the collected debris is received by the enclosed mechanical transport system, the enclosed mechanical transport system delivers collected debris to the storage compartment, the vacuum's suction transmits for at least a portion of the debris in, on, or near a portion of the transport system (e.g., airborne particulates in the transport system's housing) upstream of the storage compartment through the filtration compartment inlet, into the filtration compartment, and therein causes the portion to be filtered by the filter. The filter housing and fan system are configured such that, under the above-described operating conditions (e.g., with respect to airflow and static pressure), the portion of the debris that contact the filter is limited to about 10% or less (e.g., about 5% or less or even about 1% or less) of the total debris collected by the collection vehicle during operation.

Any of the above-described debris collection vehicles can further include (as appropriate and desired) a debris collection/handling system characterized by inclusion of a tortuous airflow passageway/path positioned between the filtration housing inlet and mechanical transport system (such that less than about 10% or less, 5% or less, or even 1% or less of the collected debris contact the filter), a v-shaped filter housing bottom (such that debris in the filter housing are substantially retained in the housing or re-deposited in the mechanical transport system and/or such that re-filtration of debris contained in the filter housing is minimized or essentially (measurably) eliminated), a selectively operable sloping and continuous conveyor system (preferably that includes a belt fitted with a plurality of full-width debris-carrying cleats), or a combination of any of these elements. Preferred debris collection vehicles also can be free of any external access to the storage compartment (other than, e.g., a door or other mechanism for dumping of stored debris), such that the vacuum generates substantially no suction force in the storage compartment during operation. Alternatively, the debris collection vehicle can comprise and/or be operated under certain conditions with one or more external vacuum hoses, such that light debris can be directly delivered to the storage compartment by the vacuum's suction force, preferably in connection with similarly collecting such debris from the mechanical transport system housing near the filter housing inlet. Such debris collection vehicles can be any suitable type of vehicle, including, for example, the preferred three-wheeled and preferred four-wheeled debris collection vehicles described in detail elsewhere herein.

The invention further provides methods of debris collection characterized by the use of any of the systems and/or debris collection vehicles described herein. Thus, for example, the invention provides a preferred method of debris collection comprising collecting debris over an area or surface with a mechanical debris collection system, which delivers collected debris to at least partially an enclosed mechanical transport system, transporting the debris with the mechanical transport system to a storage container, applying a vacuum pressure, which is substantially directed to an area of the mechanical transport system and surrounding area located upstream of a debris storage container, such that at least a portion of the debris located proximate to the discrete area is delivered to, and is filtered by, a filter positioned in a discrete filter housing, and delivering any remaining debris to the storage compartment, wherein the filter housing and storage compartment are not in direct communication with one another.

The preferred method can be further characterized by any number of additional steps that draw upon the inventive features of the systems and vehicles described herein. For example, in one aspect the preferred method can be characterized in requiring debris-carrying air delivered to the filter to flow though a tortuous path at some point between the area where the debris are removed from the mechanical transport system and mechanical transport system housing and the filter (with respect to the airflow path between the filter and that portion of the mechanical transport system/system housing). The vacuum generating substantially no suction force in the storage compartment also or alternatively can characterize the preferred methods. The preferred methods can further alternatively or additionally be characterized by the use of a sloping mechanical conveyor system, which desirably comprises a plurality of full-width cleats or ridges, as a mechanical debris transport system. Desirably, the preferred method also or alternatively can be characterized in that less than about 10%, preferably less than about 5%, or even about 1% or less of the debris collected by the debris collection system (by weight) is filtered by the filter.

Any of the above-described preferred methods also or alternatively can desirably be characterized by collecting debris of about 10 microns or less in diameter (in at least a measurable amount), preferably about 3 microns or less in diameter, and more preferably at least about 2.5 microns or less in diameter, without the use of water or other dust-suppressing liquid during debris collection.

The preferred methods can be even further characterized by the step of collecting debris by directing a portion of the vacuum suction force through one or more vacuum hoses such that debris are collected by the vacuum hoses and deposited directly into the storage compartment. Such a preferred method can be further characterized in that the debris collected through the vacuum hose make up less than about 20%, less than about 10%, less than about 5%, or even less of the total debris collected by the preferred method. Thus, for example, the preferred method can include a step of delivering debris around the periphery of the vehicle (or debris collection system) by the sweeping action of one or more gutter brooms, wherein at least a portion of the debris rendered airborne by operation of the gutter brooms is collected by one or more vacuum hoses that deposit the airborne debris into the storage compartment at a location away from the point where the mechanical transport system deposits debris in the storage compartment (typically the interior opposite sidewall). The airflow through the top portion of the storage compartment in such preferred methods can also be characterized in that the direction of such airflow is opposite to the direction of debris flow through the mechanical transport system into the opposite side of the storage compartment.

Any of the above-described preferred methods also or alternatively can include a step of removing debris bound by the filter by an agitation or shaking step (e.g., a shaking step performed with one of the above-described shaker systems), preferably by inducing operation of a shaker or agitator connected to the filter by command of the operator and/or by way of an automated system that operates the shaker/agitator when a detector detects that pressure across the filter is at or above an undesired level (examples of which are described above). Similarly, any of the above-described preferred methods can additionally include a step of slowing and/or diffusing the filtered airflow in the system or vehicle before releasing the filtered air to the environment.

For purposes of an understanding of the invention reference will now be made to exemplary debris-collecting vehicles and systems as shown in the figures and specific language will be used to describe the same. It will nevertheless be understood that no limitation of the scope of the invention is thereby intended, and that the debris collection systems and vehicles shown therein represent only some of the features of the claimed invention.

A side cutaway view of an exemplary "three-wheeled" debris-collecting vehicle of the invention is provided in FIG. 1. The vehicle 1, which is particularly useful in street sweeping and cleaning industrial areas, is controlled by a driver or operator from the enclosed cab 99, which is fitted for controls that regulate the sweeping, dumping, and other functions of the vehicle (e.g., internal component cleaning). The vehicle comprises a sturdy frame or chassis, two front spaced apart wheels 90, a dual rear wheel 95, which is under the control of a steering mechanism and other operational controls provided in the enclosed cab 99, from which an operator directs the movement and operation of the vehicle. One or both of the front wheels 90 typically serve as the drive wheel for both forward and reverse operations. The wheel configuration of the vehicle permits the vehicle to readily move through confined areas with stability and traction, particularly compared to regular four-wheel vehicles known in the art. For example, such a vehicle is capable of making a 100° turn while operating in a sweeping path of about 20 feet or less, about 15 feet or less, or even possibly about 10 feet or less.

The vehicle 1 collects debris using a system that includes a cylindrical debris-collecting brush or broom 5 (which also can be referred to as the "pickup broom" or "main broom"), transversely positioned near, and rotating along on axis parallel to the wheels 90, as indicated by arrow 6, but opposite to the direction of forward wheel rotation when in use. The rotational contact of the broom with the surface delivers (e.g., propels or throws) debris (e.g., trash, leaves, rocks, sticks, paper waste, metal shards, glass, coal, mineral debris, other industrial waste, and the like) from the surface into a debris collection inlet 10 in which the debris is received by the lower end of a continuous sloping conveyor transport system 20. The main broom 5 desirably is capable of being selectively raised and lowered to permit ease of transport when not in use and to apply added pressure (when desired) to the portion of the broom in contact with the sweeping surface. The rotation and elevation of the main broom is driven by a hydraulic motor or other suitable motor. The main broom 5 is equipped with suitable resilient debris-collecting bristles (not individually shown), which desirably are removable and replaceable. The bristle material can be selected depending on the type of debris to be collected by the vehicle (e.g., plastic bristles can be used for applications where the main broom will be required to "dig" into a pile of debris consistent to sweeping). The main broom 5 is positioned in, and enclosed by, a main broom housing (or drape) 7, which prevents the spread of airborne particles during brushing operations. The drape 7 can be made of any suitable material, such as a rubber-coated canvas or lightweight metal, and typically is fitted with a flexible bottom, such as a pliable rubber, urethane, or plastic layer, providing improved dust control and minimizing problems arising from surface impact during use. The pickup broom 5 extends across a majority of the width (e.g., at least about 65%) of the vehicle chassis, thereby maximizing the area of debris collection. In this respect, the pickup broom 5 commonly will be about 50 inches or more in width.

The conveyor transport system 20 includes a ridged continuous (not separated) conveyor belt 25, which preferably comprises a plurality of full width cleats at regular spaced intervals (not shown) and a powered drive system 30. The conveyor system 20 takes a sloping and continuous path through an interior portion (chamber) of the vehicle from the debris inlet 10 to the interior access 75 to the hopper storage compartment 70. The sloping, continuous, and cleated conveyor belt transports debris with the occurrence of little or no jamming during normal operation, and particularly less frequent jamming than is associated with squeegee-type conveyor belts and/or paddle elevator type of conveyor belts known in the art. The conveyor system may be adjustable in position, allowing the operator to bring the upstream-most portion of the conveyor belt closer to the main broom and/or the surface (e.g., such that the bottom most upright cleats of the belt are about 0.5-1 inch above the surface). The drive system 30 desirably is selectively operable semi-automated to desired specifications. For example, the conveyor system 20 can be configured to operate automatically when the main broom 5 is in operation and/or to automatically not operate when settings are changed for use of an attached vacuum hose (not shown). If desired, the vehicle can be configured such that such an attached vacuum hose can be used to directly deposit such debris in the hopper. When such a vacuum hose is used for debris collection, the vacuum force through the hopper can be increased by closing off a portion of the chamber wherein the conveyor system is positioned with a suitable blocking plate or seal (also not shown). Usually, such vacuum debris collection is performed when the vehicle is stationary and the main debris collection system is idle. In normal operation, the drive system 30 rotates the conveyor belt 25 at a suitable speed for delivering debris as they are collected to the hopper 70, preferably such that generation of dust particles in the chamber containing the conveyor system is minimized.

Advantageously, the debris collection vehicle is fitted with one or more peripheral or "gutter" brooms or gutter brushes 3, which desirably are attached to the vehicle by a powered, rotatable, guided swivel arm 2. The swivel arm 2 desirably is under control of a powered control system that permits the operator to select the area in which the gutter broom 3 operated, as well as permitting the operator to retract the gutter broom when not in use. Typically, the gutter broom will have a sweeping width of at least about 10 feet about the lateral pivot axis of the swivel arm. The gutter broom assembly can include a gutter broom shroud, which covers at least a portion of the gutter broom and at least temporarily retains debris particles rendered airborne by the gutter broom, thereby lowering the amount of dust generated by the vehicle during debris collection. The composition of such gutter broom shrouds is further discussed below. The gutter broom facilitates peripheral debris collection by engaging the surface and rotating in a direction perpendicular to the direction of rotation of the cylindrical main broom and front wheels (i.e., in a substantially circular direction horizontal with and respect to the surface). The movement of the swivel arm 2 and gutter broom 3 (e.g., raising and lowering of the gutter broom and rotation around the vehicle's periphery) is facilitated by a hydraulic cylinders (not shown). Suitable gutter brushes, control systems, and hydraulic cylinders are known in the art. In typical operation, the gutter broom 3 delivers debris from the periphery surrounding the vehicle to the area of the surface that the central brush 5 engages or an area of the surface that is in the forward pathway of the central brush 5.

The vehicle also includes a filter housing 50, which includes a filter housing inlet 55 and exhaust 70, and which contains a filter 60. The bottom of the filter housing is formed by a first (right) angled bottom sidewall 57*a* and a second (left) bottom angled sidewall 57*b*, which together form a v-shaped bottom portion. The v-shaped bottom portion directs debris which are deposited on the bottom portion, such as debris released from the filter upon shaking or which enter the filter housing but do not contact the filter, to slide towards and through the filter housing inlet 55, preferably such that at least some of the unbound debris in the filter housing exits the filter housing and is re-deposited in or onto the conveyor belt 25. The v-shaped portion can desirably be formed by materials that prevent debris from binding thereto by creating a smooth surface along the interior-exposed sides of the sidewalls (e.g., by coating the interior bottom sidewalls with stainless steel or a non-stick material). One or more fans (not shown) are placed upstream of the filter (with respect to airflow in the filter housing during normal operation), by positioning either on top of the filter or in an orientation perpendicular to a portion of the filter housing upstream of the filter, such that substantially all of the airflow passing through the filter housing 50 is required to pass through the filter 60. Thus, the fan or fans can be positioned between the filter 60 and the filter housing exit (exhaust) or upstream of the filter housing exit 65. In operation, the fans create a vacuum suction force that pulls air into the filter housing 50 from the chamber that houses the conveyor system 20. The filter housing inlet 55 is positioned at an angle that is about perpendicular to the path of the conveyor belt 25. As such, the suction force applied to the conveyor belt is substantially limited to a portion of the conveyor belt area 40 at and slightly upstream of the filter housing inlet. Moreover, the filter housing inlet is tilted more towards the upstream portion of the conveyor system 20 (i.e., towards the collected debris inlet 10) than the hopper 70, such that the overall vacuum suction force favors (or is strongest in) the area at or upstream of the filter housing inlet (e.g., as compared to near the hopper inlet 75).

Upon engaging the conveyor belt 25, the collected debris materials (e.g., dust, particulates, cuttings, soil, branches, clippings, etc.) are moved into the interior of the vehicle by the operation of the drive system 30. Nearing the area where the conveyor is exposed to filter having inlet 55 (e.g., at point 40), the suction force pulls air through the filter housing inlet 55 and into the filter housing 50, as indicated by arrow 56, thereby also pulling lighter airborne fugitive debris carried by the conveyor belt or that are airborne in the chamber that houses the conveyor belt (e.g., debris rendered airborne by operation of the vehicle's debris contacting mechanism) into the filter housing 50. The filter housing inlet 55 preferably includes a wire or mesh screen (not shown) that filters out larger debris carried by the airflow (e.g., objects of about 200 microns or more in size, preferably objects of about 150 microns or more in size, more preferably objects of about 100 microns or more in size, or smaller, are blocked from entering the filter housing by the screen or mesh). The suction force creates airflow through the filter housing 50, directed to and across the filter 60. The airflow created by the fan or fans also compels the filtered air to flow out of the filter housing 50 by way of the filter housing exit, either through suction or by propulsion. The filter 60 is a multiple barrier cloth filter that has an about 10-micron or even about 2.5-micron filtering capacity. The filter and vacuum system of the vehicle permit collection of such debris by the debris collection system (the main broom and gutter broom) without the use of water, if such waterless debris is desired (e.g., in cold weather street sweeping operations or in industrial settings where polluted runoff may be a concern). The replaceable filter 60 collects debris of about 2.5-100 microns and typically retains them until a connected shaker apparatus 80 is engaged or the filter is removed. Particulates that do not reach, or do not bind to, the filter 60, typically fall due to their weight onto the v-shaped bottom portion and may thereafter slide back through the filter housing outlet (or in some instances the filter housing inlet) onto the conveyor belt 25 where they pass out of the range of the suction force. Thus, design of the filter housing 50 prevents unbound debris from gathering therein. As such, the repeated filtration of debris is reduced if not entirely eliminated by the design of the inventive debris handling system.

The filter housing also contains a shaker 80 (or "shaking apparatus") for removing debris from the filter media during operation of the vehicle, particularly when the amount of the debris in the filter reaches an undesired level. The presence of an undesired level of debris in the filter can be assessed by measuring the amount of pressure exerted across the filter under typical fan speeds (as described above, e.g., about 3000 cfm). A rise in pressure at the fan, above a certain level (e.g., about 15 inches of water, or, more preferably, about 10 inches of water), can be reported to the operator by way of a monitor or detector (not shown), alerting the operator of the need to selectively engage the shaker apparatus 80 to reduce debris load. Alternatively, the vehicle can comprise an automatic monitor and control system (which preferably is selectively overridable by the operator) (not shown) that operates the shaker 80 when such pressure levels occur. A motor, which can be any suitable motor, compels the shaker to rotationally impact (if not also move in an up-and-down motion), such that the shaker agitates the cloth filter bank with a level of force/speed where at least a significant proportion (e.g., at least about 5%, at least about 10%, at least about 25%, or more) of the debris in the filter is released. Usually and preferably, the operation of the shaker apparatus 80 does not coincide with operation of the conveyor and fan systems. As such, the vehicle typically includes a control system (e.g., an automated electrical circuit) that ceases or substantially reduces the operation of the conveyor and fan systems when the shaker is in use.

The filter housing 50 is divided by an impermeable barrier or seal 67, in which the filter is sealingly positioned. The impermeable barrier 67 requires that all of the airflow passing through the filter housing pass through the filter 60. Attached to the impermeable barrier 67 is a hold down bracket 69, which is usually fitted with one or more retaining bars that are positioned above the filter media to maintain the filter in position as well as keep the pockets of the filter separate. Above the filter 60 and impermeable barrier 67 is the top level of the filter housing 68, from which the filtered air is permitted to exit the filter housing by way of a filter housing exit or exhaust (not shown), which subsequently feeds into the airflow exhaust of the vehicle (also not shown).

Debris remaining on or in the conveyor belt 25 downstream of the portion of the conveyor housing 40 exposed to the filter housing inlet 55, and any debris released from the filter housing, are transported to the hopper inlet 75 and deposited into the hopper 70 by the rotating motion of the conveyor, as indicated by arrow 72. The hopper 70 is a large single chamber hopper, formed from either steel or aluminum construction, which typically has an internal volume of about 2-4 cubic yards (e.g., about 3 cubic yards) and a weight capacity of at least about 5,000 pounds (typically the hopper can reasonably contain about 8,000-12,000 pounds of debris, even in jobs where the hopper is lifted well above its normal position as discussed in greater detail herein). The size of the hopper 70 induces lighter debris therein to settle below the top area of the hopper at a point away from the hopper inlet, such that stored debris do not easily escape from the hopper and into the conveyor belt area. The level of debris can be inspected and/or monitored by inclusion or more windows or more complex monitoring systems, such that the operator can prevent the level of debris from rising to a level where re-release of stored debris is likely. The hopper desirably is accessible from the outside of the vehicle by way of at least one door and/or a release mechanism ("dump mechanism"), which release mechanism typically is in the form of a series of hydraulic or mechanical presses or lifts. Commonly, such a hopper can be detached from the rest of the vehicle body, and tilted to an angle of up to about 40-50°, either at ground level or elevated heights of up to about 10 feet above the hopper's resting position (e.g., about 5-10 feet above the hopper's normal position in the vehicle).

As mentioned above, an attachable vacuum hose (not shown) can be connected to the hopper 70 by way of a hose inlet (not shown). In such vehicles, the vehicle also preferably is fitted with a barrier ("block off plate"), seal, or other blockage (not shown) that seals off the portion of the conveyor system chamber upstream of the filter housing inlet when the attachable vacuum hose is in operation, such that a vacuum force is generated across the upper portion of the hopper that is strong enough to bring relatively light debris directly into the hopper by the suction force. In normal operations (i.e., operations not involving the attachable vacuum hose), the design of the system reduces the suction force in the hopper, such that substantially no debris in the hopper are brought into the filter housing (e.g., it is expected that less than about 10%, typically less than about 5%, and more typically less than about 1% of the debris (by weight) bound by the filter is from debris delivered to the hopper by way of the conveyor system). An artisan will appreciate that the amount of debris carried into the filter housing or "filter compartment" and bound therein by the filter will vary with the nature of the debris being collected by the vehicle (e.g., the weight and size of particulates in the collected debris).

Figure 2:
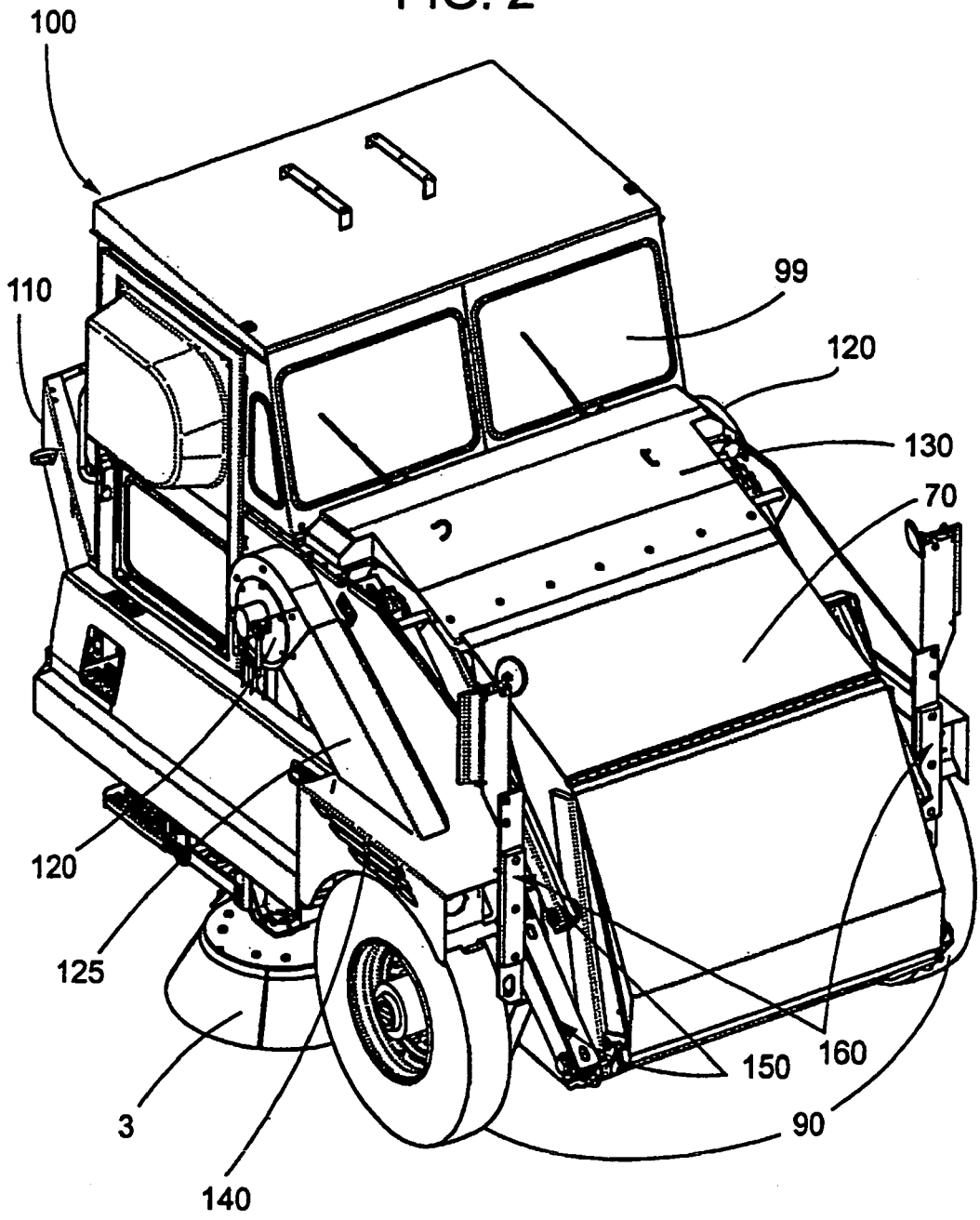
FIG. 2 offers a top isometric view of an exemplary debris collection vehicle of the invention having similar features as the vehicle shown in FIG. 1.

Referring now to FIG. 2, a similar three-wheel debris collection vehicle 100 is shown. The vehicle 100 includes a tilted-up and truncated tail end 110, in which the engine and hydraulic motor are maintained (not shown). The vehicle 100 has a dual fan vacuum system. Specifically, two fan assemblies 120 are positioned on either side of the vehicle surrounding the filter housing, the top portion of which is located beneath a filter housing access hood 130. The dual fan system creates a vacuum, which, as described above, generates an airflow that carries light debris into the filter housing and through the filter. The fans also propel the filtered air through the filter housing exit. The dual fan system then propels the filtered air through an exhaust passageway 125, which delivers the air to an area accessible to the exhaust 140. The exhaust 140 is in the form of a grille or grated area, which diffuses the filtered air while releasing it to the environment. Moreover, the sharp angle turn from the filter housing to the exhaust, the distance the air must travel in the exhaust passageway 125, and the grated exhaust 140, substantially reduce the speed of the exhausted airflow. The externally accessible filter housing hood 130 permits convenient access to the filter (e.g., for maintenance or replacement). Because the filter housing and storage compartment (hopper) are not in direct communication, the filter can be conveniently removed with substantially little or no release of stored debris from the hopper.

The vehicle 100 also is equipped with a hopper lifting assembly 150, which includes a series of interconnected, bendable sturdy lifting arms that, when compelled by operation of a hydraulic or mechanical motor under control of the operator, are capable of lifting the hopper above and/or away from the vehicle for dumping of the collected debris. The vehicle also includes bumper posts 160, to which a flexible but sturdy bumper is mounted, such that the vehicle can be placed in direct contact with a dumpster or other container during debris dumping without damaging the vehicle or impeding the path of the hopper. The posts may be fitted with rear and side view mirrors, and the vehicle may also be fitted with other standard, yet advantageous, features, such as headlights and brackets for holding an emergency or caution light on the top of the cab 99.

Figure 3:
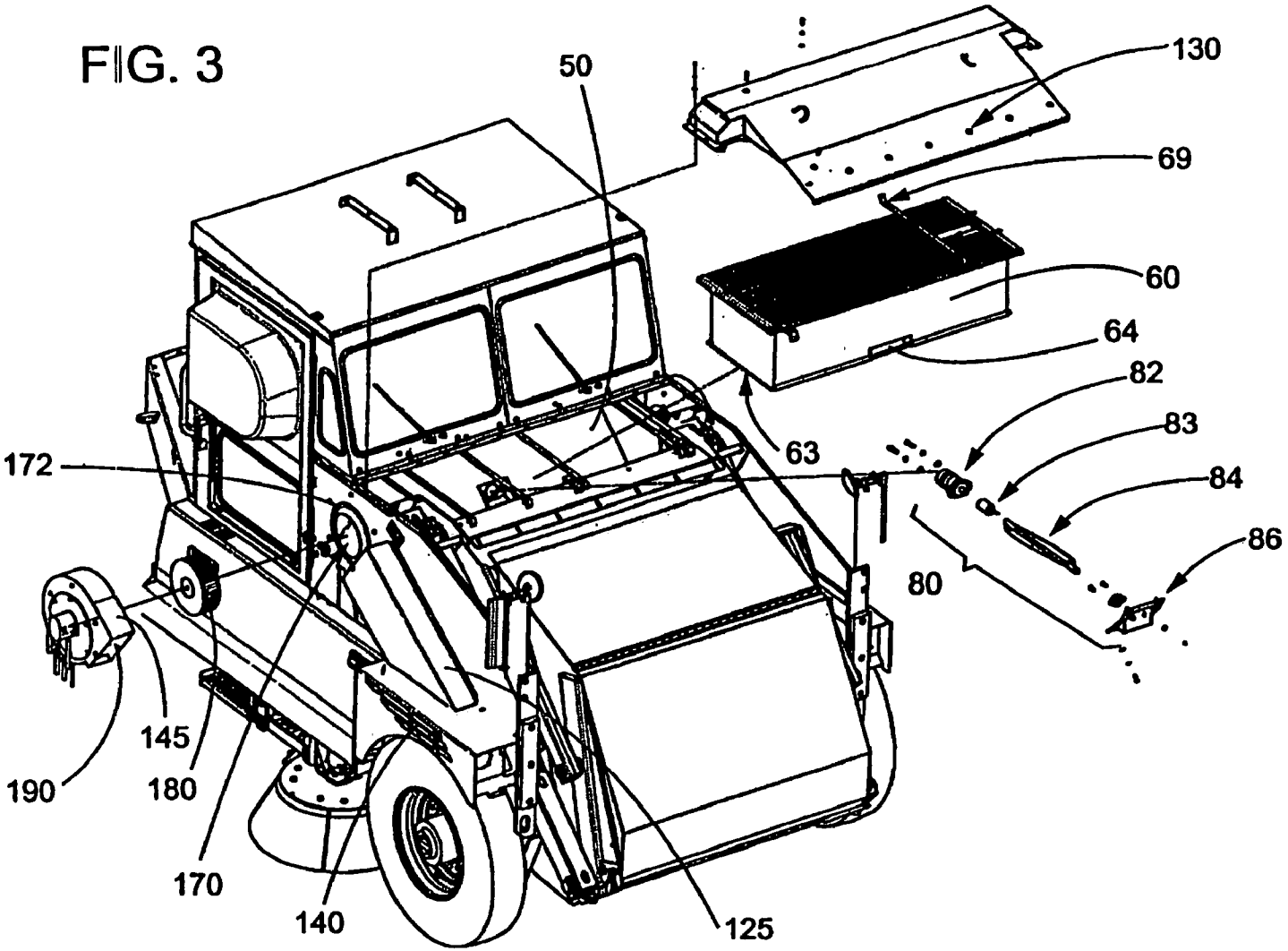
FIG. 3 provides a partial exploded view of the exemplary debris collection vehicle shown in FIG. 2.

FIG. 3 provides a partially exploded view of the debris collection vehicle shown in FIG. 2. The exploded view provides an isometric view of the filter 60, which includes multiple barriers or pleats formed from cloth media, singed polyester, or other suitable media. A series of grooves positioned under the filter 60 engages a set of lower stabilizing bars or rods (not shown) to assist in retaining the filter in position (both with respect to position in the filter housing and retaining space between the several barriers of the filter, thereby maximizing filter efficiency). The filter assembly 60 also can be fit with one or more upper retaining bars 69 that also help to keep the filter in its position within the filter housing. The filter assembly 60 further comprises a channel 64, transversely oriented with respect to the lower grooves 63, for engaging a shaker assembly 80 by its insertion therein.

The shaker assembly 80 includes a shaker motor 82, which can be, for example, a hydraulic or electric motor, a coupling 83, which transfers and/or converts energy from the motor to the beater bar 84, which engages the filter 60 and is the main component of the shaker assembly. The beater bar is positioned within a cross channel 64 positioned in the bottom of the filter. When the motor operates, the beater bar moves/agitates the filter assembly 60 thereby causing the filter media release larger/heavier and/or poorly bound debris. The beater bar 84 can be maintained in the channel 60 by one or more end covers 86, which are attached to the outside of the filter. A series of connective screws and a bearing may interconnect these components.

Each fan is positioned in an orifice 170, which is surrounded by an annular seal 172, such that the fan assembly sealingly engages the vehicle frame with sufficient force to retain vacuum pressures as described above. The fan assembly typically includes an impeller, such as a squirrel cage impeller 180, encased in a fan or impeller housing 145, which has an outlet 190 essentially perpendicular in orientation to the direction of airflow through the orifice 170, such that filtered air exiting the filter compartment is forced to make a sharp angled turn before flowing through the exhaust chute or pathway 125. The fan housing 145 sealingly engages or is welded to the exhaust chute 125, such that a closed airflow path is formed from the fan housing outlet 190 into the exhaust chute 125. The exhaust pathway feeds airflow to a point where air is forced to exit the vehicle by way of the grille exhaust 140. The operation of the fan configuration included in the exemplary debris collection vehicle is made possible by use of fan having axially oriented, rather than radially oriented, fan blades.

Figure 4:
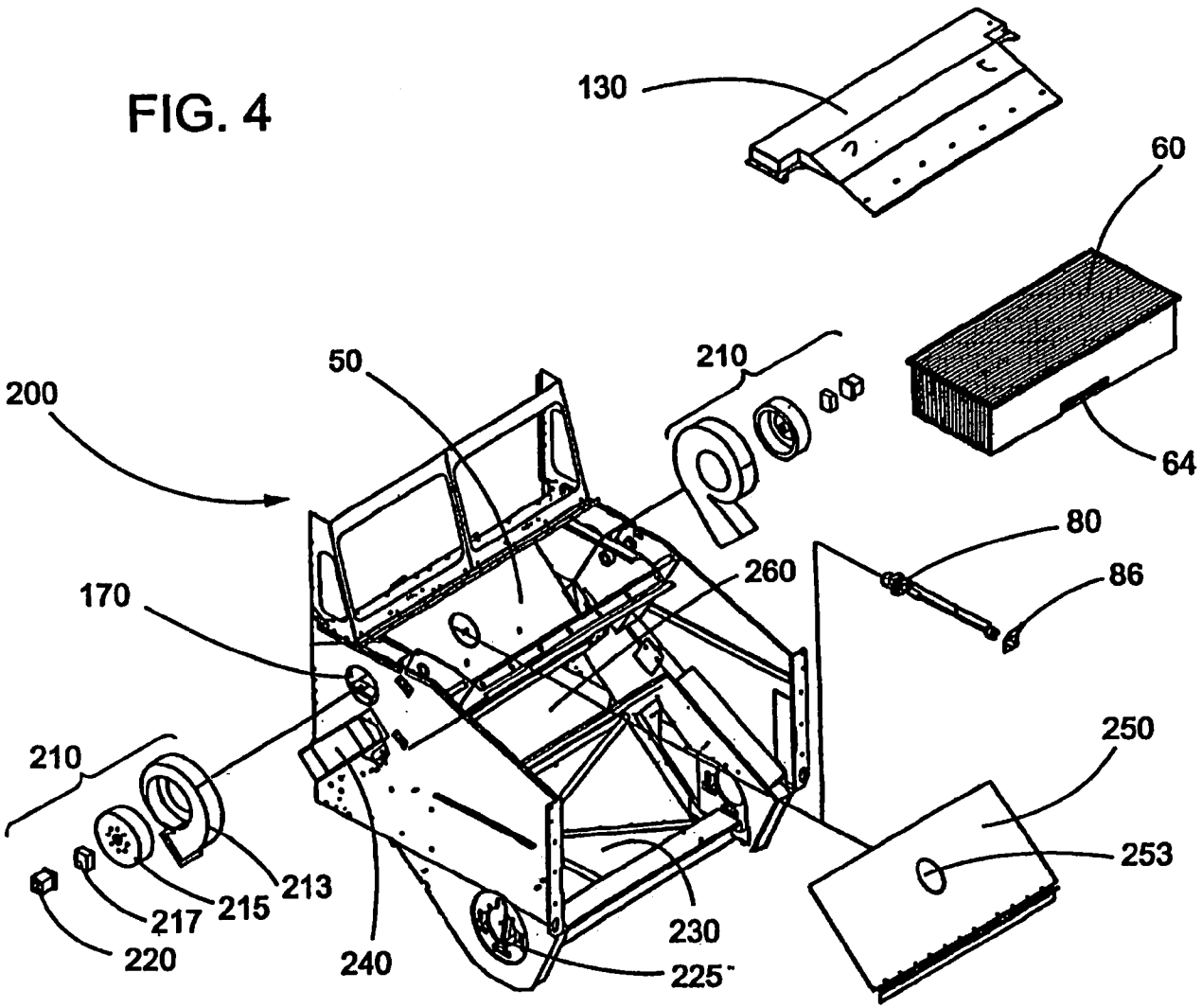
FIG. 4 sets forth an exploded view of a portion of a debris collection system of the invention.

FIG. 4 is an exploded view of a modular unit 200 that can be incorporated into a debris collection vehicle of the invention (such as one of the above-described three-wheel vehicles) that coordinates the main elements of the inventive debris handling system. The unit/system 200 is formed from a unitary but divided frame, which forms, among other chambers/passageways, the cavity or interior of a filter housing 50, in which a removable/replaceable filter 60 can be positioned. The filter 60 is enclosed within the filter housing by way of a filter housing hood 130 (a sealable top end plate (not shown) also can be used to maintain vacuum presence in the filter housing). A cavity 230 located near the bottom of the unit is designed to receive a portion of a removable hopper (not shown), similar in shape and operation as the hopper discussed above with respect to the vehicle of FIG. 1. A central passageway 260 is capable of housing the upper end of a conveyor system (not shown) allowing access to a hopper inlet. An internal back plate 250 is positioned within the filter housing, thereby forming one interior side of the v-shaped bottom portion. The back plate 250 includes an oval hole through which a portion of the shaker assembly 80 extends into the filter. The frame of the unit includes a drive system cutout 225, which serves as a connecting point for the vehicle's drive system, wheels, and possibly other components.

The exploded view of the system/unit in FIG. 4 also shows a more detailed view of an exemplary vacuum fan assembly 210, which includes a fan impeller 215, a blower/housing unit 213, and a bearing block 217, which supports the fan's hydraulic motor component 220. The fan assembly 210 feeds exhausted air into an annular fan housing outlet 240, which typically engages an exhaust pathway component (not shown), similar to the exhaust chute described above. The fans also may be configured in series.

Figure 5A:
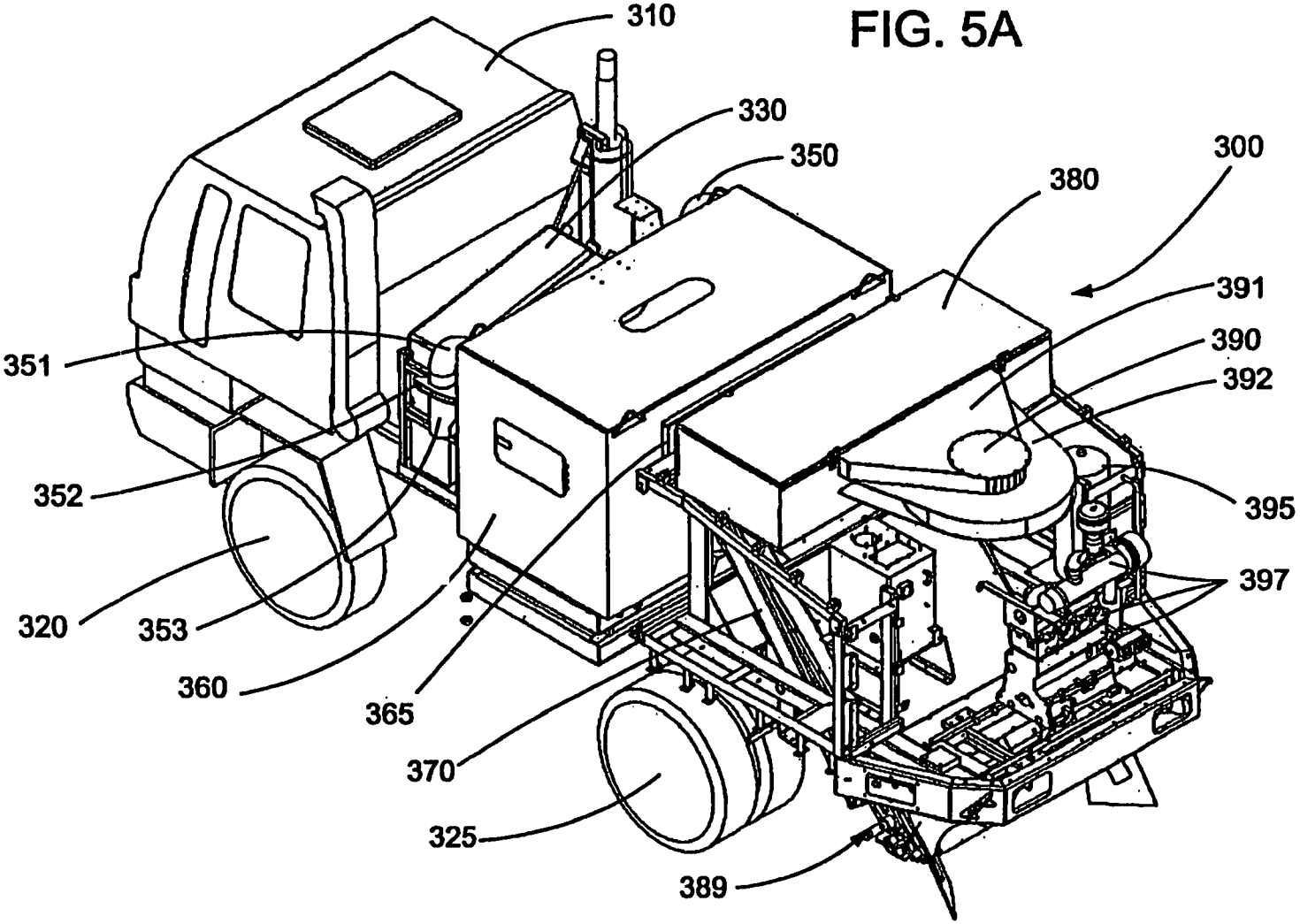
FIGS. 5A and 5B provide a top isometric partial cutaway view of an exemplary four-wheeled debris collection vehicle of the invention.
Figure 5B:
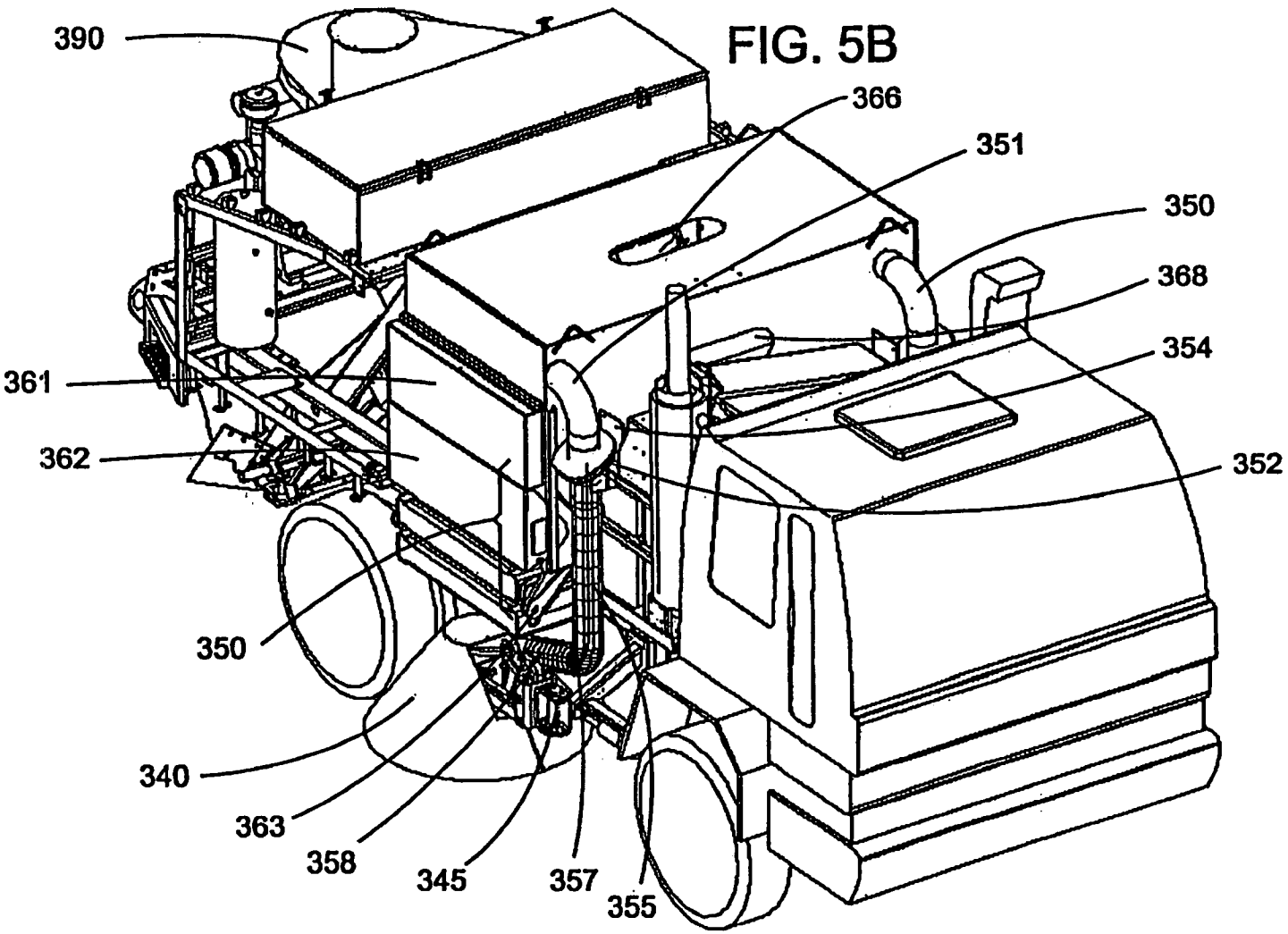

FIGS. 5A and 5B provide partial cutaway views of a preferred four-wheeled debris collection vehicle of the invention. The vehicle 300 includes an operator cab 310, forward wheels 320 and rear wheels 325 (the vehicle preferably having powered four-wheel steering, a turning radius of about 80-90 inches or less, and being capable of transit speeds of at least about 50 miles per hour (mph), which is about 1.5-2 times faster that the maximum safe transit speeds associated with the above-described three-wheeled collection vehicles and about 3 or more times faster than usual debris collection speeds of either type of vehicle).

A large hopper 360 is positioned near the center of the vehicle. The hopper 360 has an internal volume of about 5-7 cubic yards. Positioned closer to the back end of the vehicle is the filter housing 380, below which sits most of the sloping continuous conveyor system 370. The conveyor system typically comprises a continuous conveyor belt fitted with full-width cleats (not shown) and a pressurized air conveyor lift system, which moves the conveyor to different positions for transit and debris collection. The conveyor belt feeds the substantial majority of the debris collected by the vehicle into the hopper 360 by way of the hopper inlet 365. At the backside of the filter housing 380, the fan housing 390 is positioned. The fan housing 390 is composed of an upper chamber 391, the interior of which is in communication with the interior of the filter housing 380, and a lower chamber 392, which is in communication with the filter housing exhaust (not shown) and which houses the fan apparatus (not shown). As described above, the fan apparatus generates a vacuum suction force that brings air from the chamber that houses the conveyor system (and light particulate debris) into the filter housing wherein the air passes through the filter (not shown), which binds and retains the lighter debris.

The cutaway view of the vehicle 300 in FIG. 5A, also shows the diesel/hydraulic motor 397, which is used for the lifting and lowering of the hopper 360, the main broom and related assembly, and, optionally, any gutter brooms (e.g., a front gutter broom and/or one or more side gutter brooms). At the bottom back end of the vehicle, the main broom assembly 389, without an attached main broom or "pickup broom," also is shown. The assembly 389, as well as the conveyor system 370, desirably can be selectively moved (typically raised) during high speed driving to a position that does not impede the movement of the vehicle and/or risk damage to the components.

The vehicle 300 also is fitted with two partially fixed vacuum hose assemblies 350, which are located near the front top end of the hopper 360. Each partially fixed vacuum hose assembly includes a sturdy elbow portion 351, which is fixedly attached to the hopper 360, and a weldment 353, around which a flexible vacuum tube (not shown) can be fit, and which sealingly engages the elbow portion 351 by way of a clamp/seal 352. The interior of the weldment 353, clamp 352, and elbow portion 351, communicate with each other, as do the interior of the elbow portion 351 and the interior of the hopper 360.

An opposite view of the above-described vehicle 300, fitted with a full vacuum hose assembly 350 connected to and in airflow communication with a gutter broom assembly 340, is shown in FIG. 5B. On this side of the vehicle, the exterior of the hopper 360 includes full-width top doors 361 and 362, which may be openable to remove debris from the hopper, such that up to ⅔rds of this side of the hopper can be selectively opened during debris dumping. In dumping operations, the hopper 360 can be selectively raised and moved away from the rest of the vehicle (e.g., to access a dumpster or other suitable container) by way of a selectively operable hydraulic lift system 363. Typically, the hopper is raised and turned, such that when the doors 361 and 362 are opened, they are positioned towards the bottom of the hopper, such that the stored debris are allowed fall through the doors into a suitable container by way of gravity. Using known hydraulic lift systems, a hopper having a volume of about 6 cubic yards, a capacity of about 8,000-12,000 pounds, and similar placement, can be lifted up to about 6 or more feet above the vehicle's frame and/or tilted up to 40-50° or more for debris removal.

Attached to the hopper 360, is a full vacuum hose assembly 350. As shown in FIG. 5B, the vacuum hose assembly 350 includes a main flexible sleeve portion 355, located below the clamp 352, and fitted around the weldment 353, and optionally and preferably held in place by application of the clamp 352. The lower end of the main flexible sleeve 355 is connected to a flexible elbow portion 357, which is connected to a bottom tube portion 358. The bottom tube portion 358 and can be attached to the interior of the gutter broom shroud 340, which encases the gutter broom (not shown). The main sleeve 355, flexible elbow 357, and bottom tube portion 358, are typically made from a suitable flexible material, such as a vinyl, rubber, or urethane tubing, that is surrounded with a spinal reinforcement that typically is made from a sturdier plastic or metal material, ensuring that an airflow passageway is retained between the vacuum tube portions. As suggested, the bottom tube portion 358, flexible elbow 357, and main sleeve 355, are in communication with one another and with the other portions of the assembly. As such, air brought into the interior of the bottom tube portion 358 from within the gutter broom shroud 340, flows into and through the flexible elbow portion 358, up through the main sleeve 355, through the weldment 353, clamp 352, and fixed/sturdy elbow portion 351 and thereafter, into the hopper 360.

The flexible portions of the assembly are attached to the body of the vehicle by a mounting bracket 354. Normally, the hose assembly can be maintained in position during both high-speed transport and debris collection operations. The configuration of the system permits rapid removal and/or replacement of the flexible vacuum hose portions, which can be readily connected or reconnected to the weldment and mounting bracket.

The gutter broom is retained in the gutter broom shroud 340, which is a flexible housing made from any suitable material (e.g., a rubber-coated canvas, typically fitted with a bottom flexible rubber portion (made from, for example, a masticated rubber) that engages the surface). The gutter broom shroud 340 decreases the amount of airborne debris released into the environment by operation of the gutter broom, and maximizes the debris-collecting ability of the small suction force transmitted through the fixed vacuum hose assembly. The gutter broom and shroud 340 are connected to a rotating swivel or guide arm 345 that allows the broom/shroud assembly to be selectively moved by the operator (e.g., by a joystick control). Powered movement of the guide arm and the operation of the gutter broom is obtained by connection of the swivel arm and other related components to any suitable electric, hydraulic, pneumatic, or other motor. In operation, the gutter broom engages the surface, rotating around an axis essentially normal to the surface bringing debris into the path of the main broom (as such, the shroud 340, can have an opening or access facing the interior of the vehicle (not shown), or, more typically, the gutter broom will partially extend below the shroud when in use). The suction force generated by the fan is applied in the shroud (as well as at the filter housing inlet) with sufficient pneumatic force/velocity to move air and small particulate fugitive debris from the shroud through the fixed vacuum tube assembly 350 and into the hopper 360 (albeit with significantly less force than the suction force applied to the conveyor belt). Fugitive debris particles carried in the airflow from the shroud 340 to the hopper are delivered to the interior side of the hopper opposite of the side comprising the hopper inlet 365. Due to the size of the hopper, even most light debris brought through the fixed vacuum tube will settle before reaching the side of the hopper comprising the hopper inlet. As such, substantially no debris are carried from the gutter broom shroud area to any portion of the vehicle other than the hopper. The small amount of debris that may pass through the entirety of the hopper to enter the chamber housing the conveyor system and typically will be brought into the filter housing 380 and into contact with the filter therein. It is expected that less than about 15% (e.g., about 10% or less), more typically less than about 5%, and even more typically, less than about 1% of the debris that enter the filter housing will have passed through the hopper before reaching the filter housing.

In some aspects, the flexible vacuum hose portions of one or more full (at least partially fixed) vacuum hose assemblies can be removed and replaced with a wandering vacuum hose (not shown), which can be sealingly engaged to any appropriate part of the partially fixed vacuum hose assembly. The operation of such a wandering vacuum hose is typically carried out under similar conditions as those described herein with respect to other wandering vacuum hose attachments. Thus, in such vehicles, the vehicle can be fitted with block off plates, seals, or other suitable devices and/or systems for isolating portions of the vehicle from the vacuum force applied across the hopper, thereby increasing the suction force through the wandering vacuum hose during operation, which normally occurs while the vehicle is stationary and other systems idle.

Any suitable number of the vacuum assemblies can be used at any given time. To facilitate selective operation, any assembly can be configured such that the hoses are shut off, as desired, thereby increasing the suction force to a particular hose or particular subset of hoses. For example, an assembly can be configured such that a block of plate or other mechanical shut off device can be manually applied during sweeping operation, such that the suction force is only applied through a particular vacuum hose assembly. The system also can further include an air cylinder or hydraulic cylinder operably connected to a blocking plate, shut off valve, or the like, which closes off selected vacuum hose assemblies, as desired, upon command by the operator.

It should be understood that some or all of the partially fixed vacuum hoses can be advantageously operated without connection to a gutter broom assembly. Thus, one or more of the ends of the vacuum hose assemblies can be maintained at a desired position near to the sweeping surface such that the amount of fugitive dust generated by operation of the debris contacting mechanism is further reduced by direct collection of such debris into the vacuum hose or vacuum hoses.

The hopper 360 can be fitted with a front window 368 and/or top window 366, which can be made from any suitable see-through material. The front window 368 permits the operator to check the amount of debris in the hopper during operation and/or transport. The top window 366 allows light to enter the hopper to help the operator assess the level of debris.

Figure 6A:
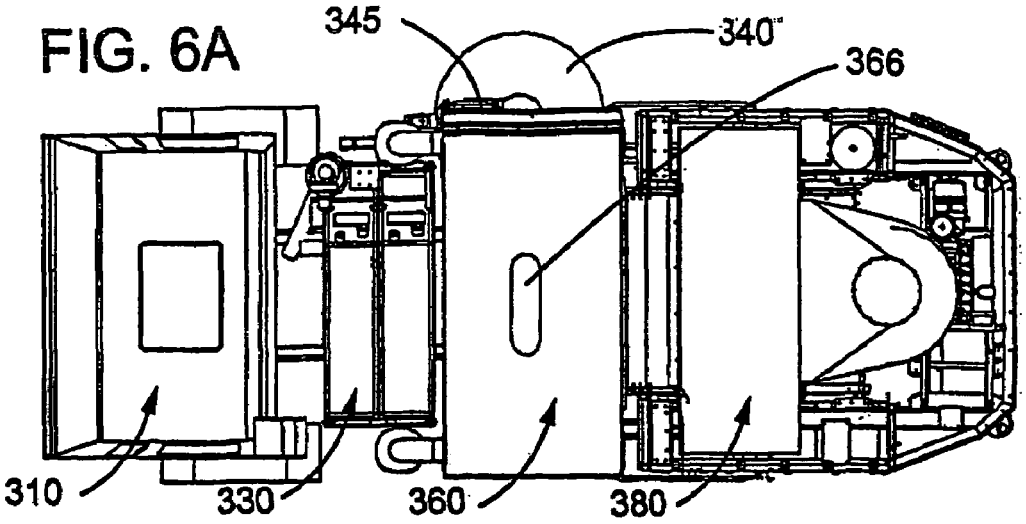
FIG. 6A provides a top view and FIGS. 6B-6C opposite side views of the exemplary debris collection vehicle shown in FIGS. 5A and 5B.
Figure 6B:
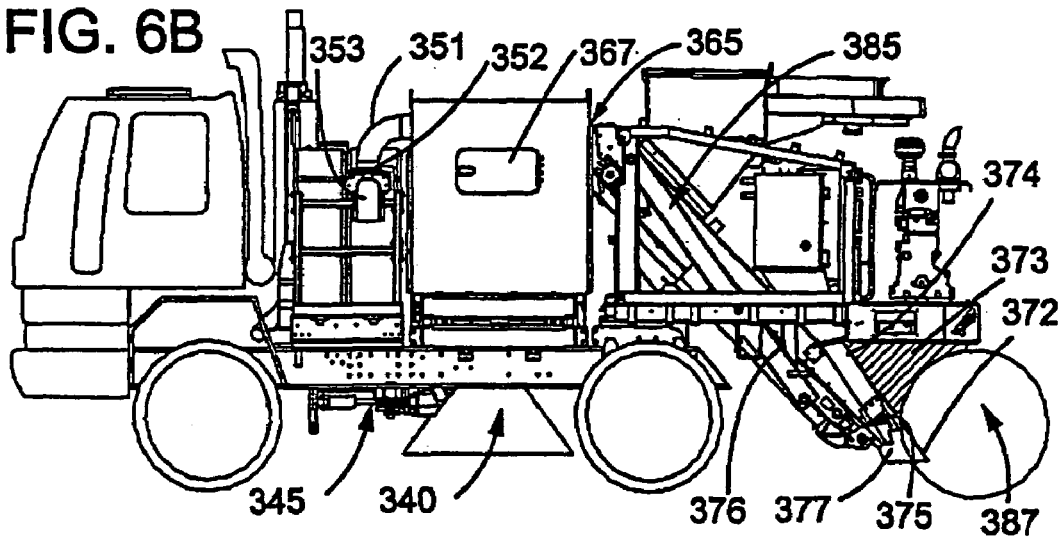
Figure 6C:
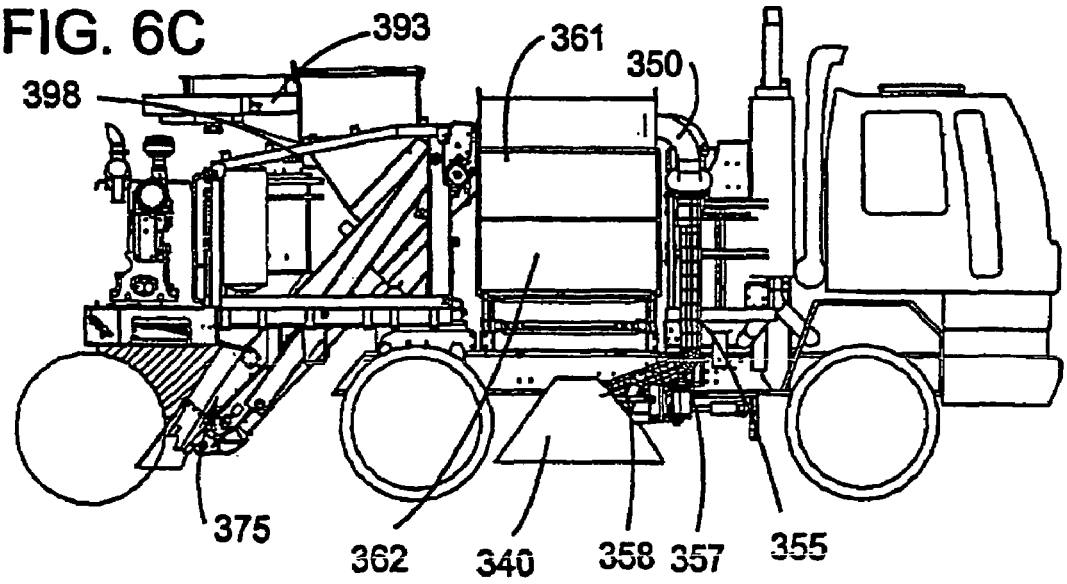

Partial cutaway top and side views of the above-described four-wheeled debris collection vehicle are provided in FIGS. 6A-6C. The four-wheeled vehicle is equipped with a multi-barrier cloth filter (not shown) and vacuum system that is capable of waterless collection of PM10 debris (particulate debris of about 10 microns or less in length, e.g., about 2.5-10 microns). However, the use of water or another suitable liquid during debris collection can be desired in some situations for dust/particulate control. As such, the vehicle is fitted with tanks 330 containing a liquid dust suppressant (typically water), which can be applied by way of an array of power sprayers/nozzles (not shown) driven by any suitable type of pump placed manual and/or automatic control. The vehicle also can be equipped with a separate water or cleaning fluid tank for feeding a selectively and/or automatic system for cleaning the components of the debris collection/handling system (e.g., the conveyor system), which typically is positioned in the rear of the vehicle near the vehicle's engine, muffler, etc.

As can be seen in FIG. 6B, the exterior hopper also can be equipped with a side inspection door 367, that allows the operator to easily access the interior of the hopper. FIG. 6B also shows the attachment of a main broom 387, generally similar in configuration and operation to the above-described debris collecting pickup brooms. In operation, the main broom 387 propels debris towards the bottom or upstream portion of the conveyor belt 375, which is surrounded by a chute assembly that includes a chute 373, a rigid frame portion 374, and a flexible lower frame portion 377. The flexible lower frame portion 377 typically is made of a material suitable for coming into contact with the sweeping surface when the main broom is in use (e.g., a flexible resilient natural or synthetic rubber). The frame portions 374 and 377 are angularly directed toward the bottom portion of the conveyor belt 375, and the chute 373 is attached thereto, such that the chute and frame portions form a v-shaped and/or funnel-like end that directs debris to the relatively narrow upstream portion of the conveyor belt 375 from the full width of main broom 387, which usually spans almost the full width (at least about ⅔rds or more) of the vehicle.

Once delivered to the bottom portion of the conveyor belt 375, the collected debris are transported along the conveyor belt, assisted by full-width cleats fitted thereto (not shown), until the debris reaches the area where the filter housing inlet 385 is positioned. In this area the vacuum suction force produced by the fans of the system is maximized such that debris-laden air in the chamber housing the conveyor belt is brought into the filter housing from this portion in the conveyor housing. The remainder, and substantial majority, of the collected debris remain on the conveyor and are delivered into the hopper inlet 365. The conveyor is mounted on a selectively adjustable pivot assembly 376, which raises, lowers, and permits the conveyor to pivot in operation, such that the conveyor can be placed in a lower position for debris collection operation (typically a position such that the cleats at the bottom portion are within about 1.5 inches of the surface) and a raised position during high speed transit.

The side view of the debris collection vehicle in FIG. 6C shows the positioning of filter housing exhaust 393, as well as the side view of the frame, which supports the top portion of the filter housing 380.

Figure 7:
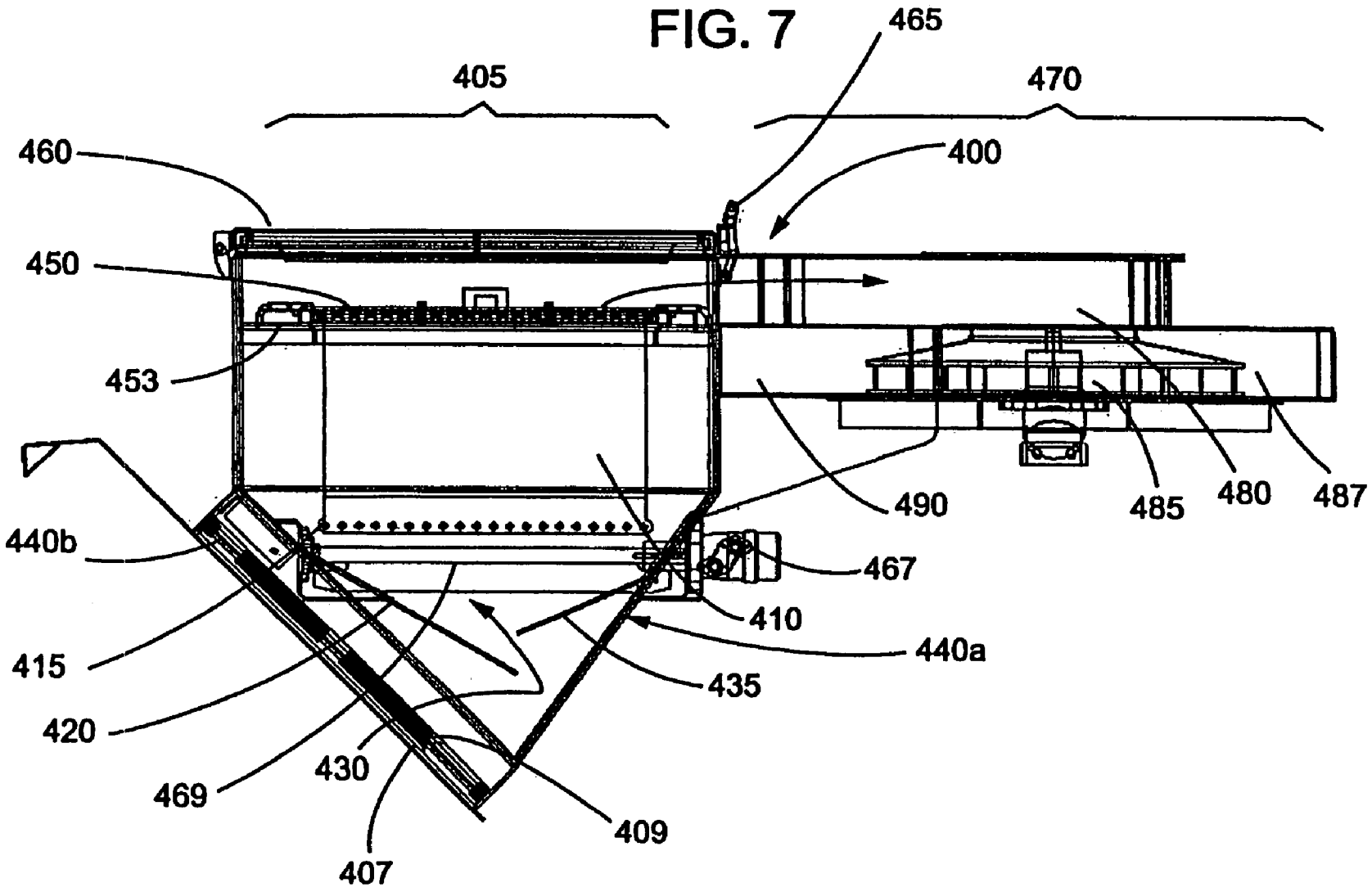
FIG. 7 sets forth a side cutaway view of an exemplary filter fan assembly of the invention.

A cutaway view of an exemplary and preferred fan and filter system 400 of the invention is shown in FIG. 7. The system 400 includes a filter housing assembly 405 and a fan housing assembly 470. The filter housing assembly includes a multiple barrier cloth filter 410, as described above, which includes a series of holes 415 that can be filled with a set of bottom retaining bars (not shown), which thereby maintain the filter in position and help keep the filter media's multiple barriers separate during filter operation (thereby preventing undesired filter plugging). At the top end of the filter, a series of top retaining bars 450 perform similar functions. The filter 410 is sealingly positioned within an opening in an impermeable top portion 453, which prevents airflow from going around the filter. As such, all of the debris-laden airflow is propelled through the filter before reaching the fan assembly 470. The top of the filter housing conveniently can be accessed by way of a removable top end plate 460, which is sealed to the top sidewalls of the filter housing by way of one or more side clamps 465, which permit rapid inspection and/or replacement of the filter or other maintenance of the filter housing as desired. The filter assembly includes a powered shaker agitator system 469, comprising a hydraulic motor 467, which can be manually automatic control (e.g., under control of an automatic detection and control system that operates the shaker when a particular pressure is obtained and/or some other condition occurs in or across the filter). The bottom of the filter housing is surrounded by sloping bottom walls 440*a* and 440*b*, which form a v-shaped bottom portion, that substantially reduces the amount of particulates retained in the filter housing when such particulates are released from or not retained by the filter media.

The filter housing inlet 407 is located within the left side of v-shaped bottom portion. Spanning the inlet 407 is a fine wire mesh screen, which is capable of blocking most debris particulates of about 100 microns or more in size. After passing through the inlet and screen, airflow is required to travel through a tortuous path as indicated by arrow 430, created by a left bar 420 and a right bar 435, which protrude from the sidewalls of the filter housing into the interior thereby, blocking the otherwise direct flowpath of air traveling towards the filter 410. The tortuous path, as indicated by arrow 430, reduces the vacuum force outside of the top portion of the filter housing 405 and reduces the number of large debris that reach the interior of the filter housing 405 where the filter 410 is located. After passing through the tortuous path, the suction force of the fan pulls airflow across the multiple barrier filter 410, wherein debris particulates of about 2.5-100 microns are retained. Debris that are not captured or that are released by the filter (e.g., debris released from the filter media upon operation of the shaker assembly 469), drop to the slanted bars that form the tortuous path, and possibly to the v-shaped bottom portion, where they are re-released to the conveyor belt for deliver to the hopper. Airflow passing through the filter housing 405 is directed to the fan assembly 470.

The fan assembly 470 includes a top chamber 480, which communicates with the top portion of the filter housing 405, located upstream of the filter 410 (i.e., above the top portion barrier 453). The fan 485 is positioned in the lower chamber 487, which communicates with the upper chamber 480 but not directly with the filter housing 405. In the configuration shown in FIG. 7, the fan 485 is positioned inverse to the top of the fan housing (i.e., the fan faces a bottom section of the lower chamber 487). Such a configuration permits the fan housing to be placed adjacent to, rather than on top of, the filter housing 405, thereby increasing the potential size of the filter housing 405 and other components of the system and allowing the components to fit within a typical four-wheel vehicle frame with ease. Moreover, such a configuration permits the filtered air to be exhausted by way of a duct system oriented along the side of the vehicle, rather than above, the filter housing (not shown). In this respect, one side of the lower chamber 487 includes a filter housing exhaust 490, which typically feeds the airflow to a diffusion system (not shown) that can include, e.g., a grille, a screen, a long pathway, a tortuous path, or combination thereof, such that exhausted airflow is diffused before being released into the environment.

The above-described similar fan and filter systems are, in and of themselves, a feature of the invention (in addition to being an optional aspect of the inventive debris collection vehicles and systems described herein).

Figure 8A:
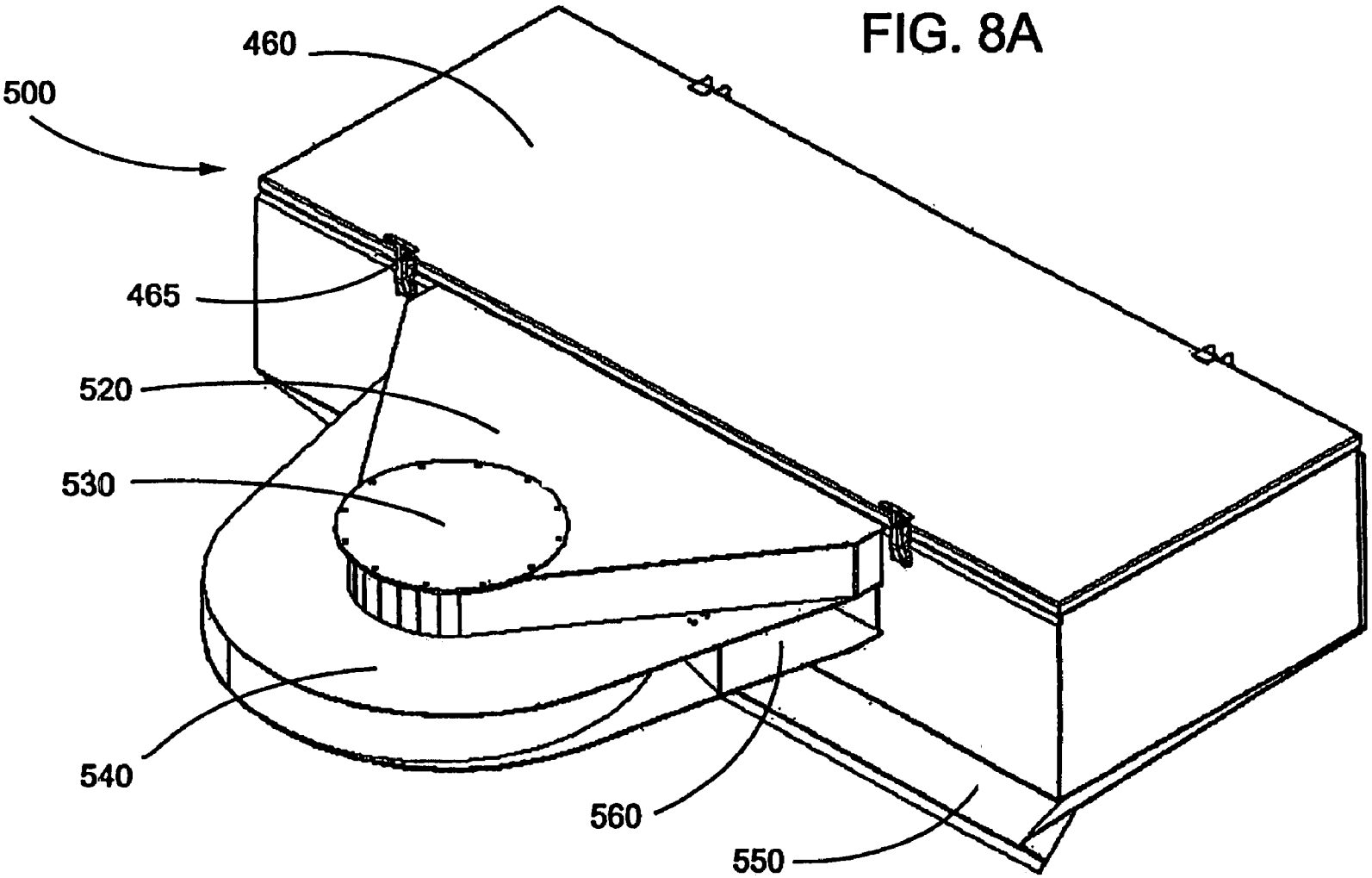
FIG. 8A provides a top isometric view and FIG. 8B offers a top surface view of the exterior of a filter and fan assembly of the invention.
Figure 8B:
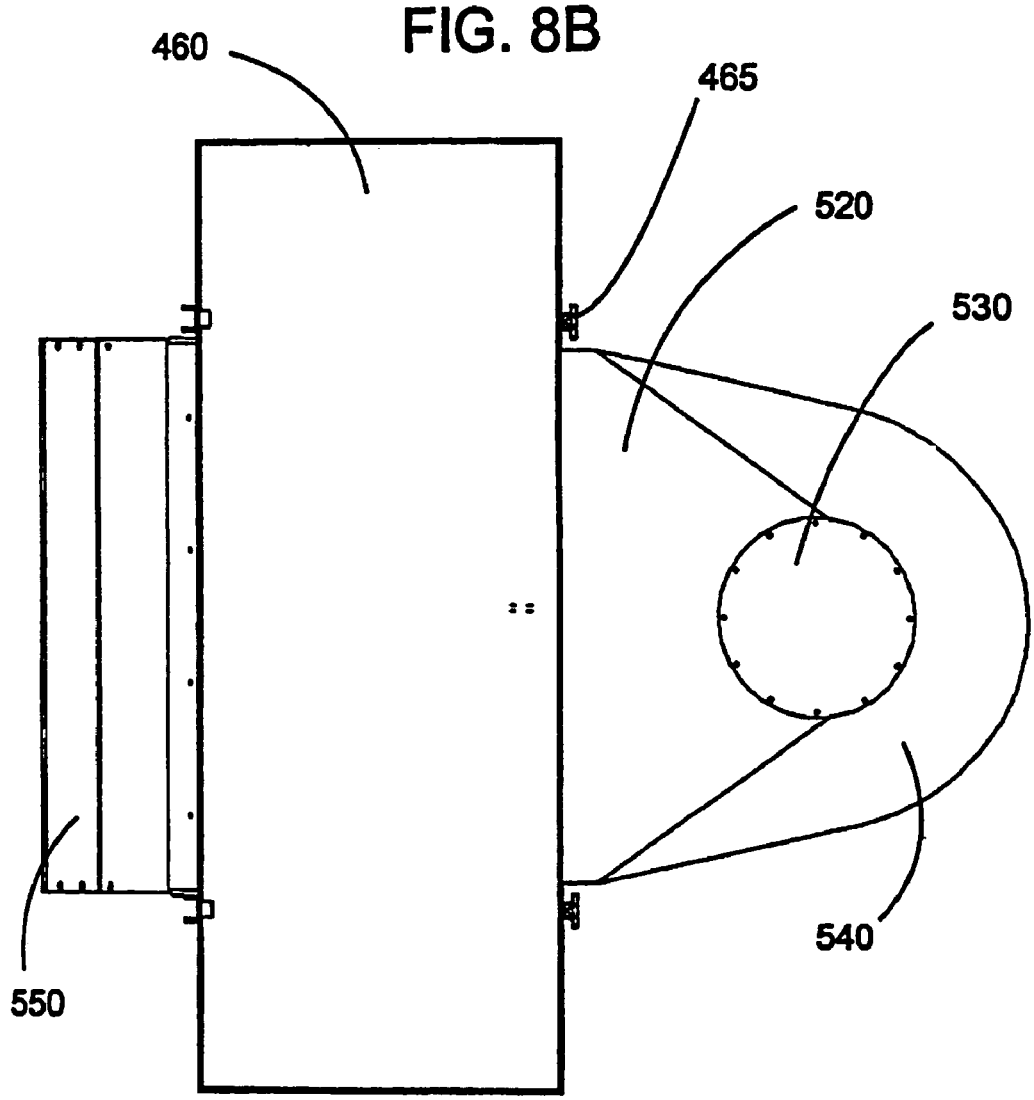

FIGS. 8A and 8B collectively provide external views of a preferred fan housing and filter housing assembly 500 of the invention. As shown therein, the fan housing is attached to the top side of the filter housing. By placing the fan housing to the side of the filter housing, rather than on top of it, the amount of vertical space required for the fan and filter housing in one of the debris collection/handling systems or vehicles of the invention is reduced. As such, the size of the filter housing can be increased to accommodate a tortuous path and/or larger filter, and the positioning of the filter housing with respect to the conveyor belt can be improved over systems comprising top-to-bottom fan/filter housing configurations.

The top chamber of the fan housing is divided between the passageway chamber 520, the interior of which communicates with the interior top portion of the filter housing, and a circular cover 530 that can be removed for access to the fan's impeller. The bottom portion 540 holds the fan and scrolls into a filter housing outlet 560. At the bottom side of the filter housing, a sloping edge portion 550 mounts to a portion of the conveyor system and/or a portion of the chamber that houses the conveyor system (not shown), thereby maintaining the filter housing in position with respect to the conveyor system.

Figure 9:
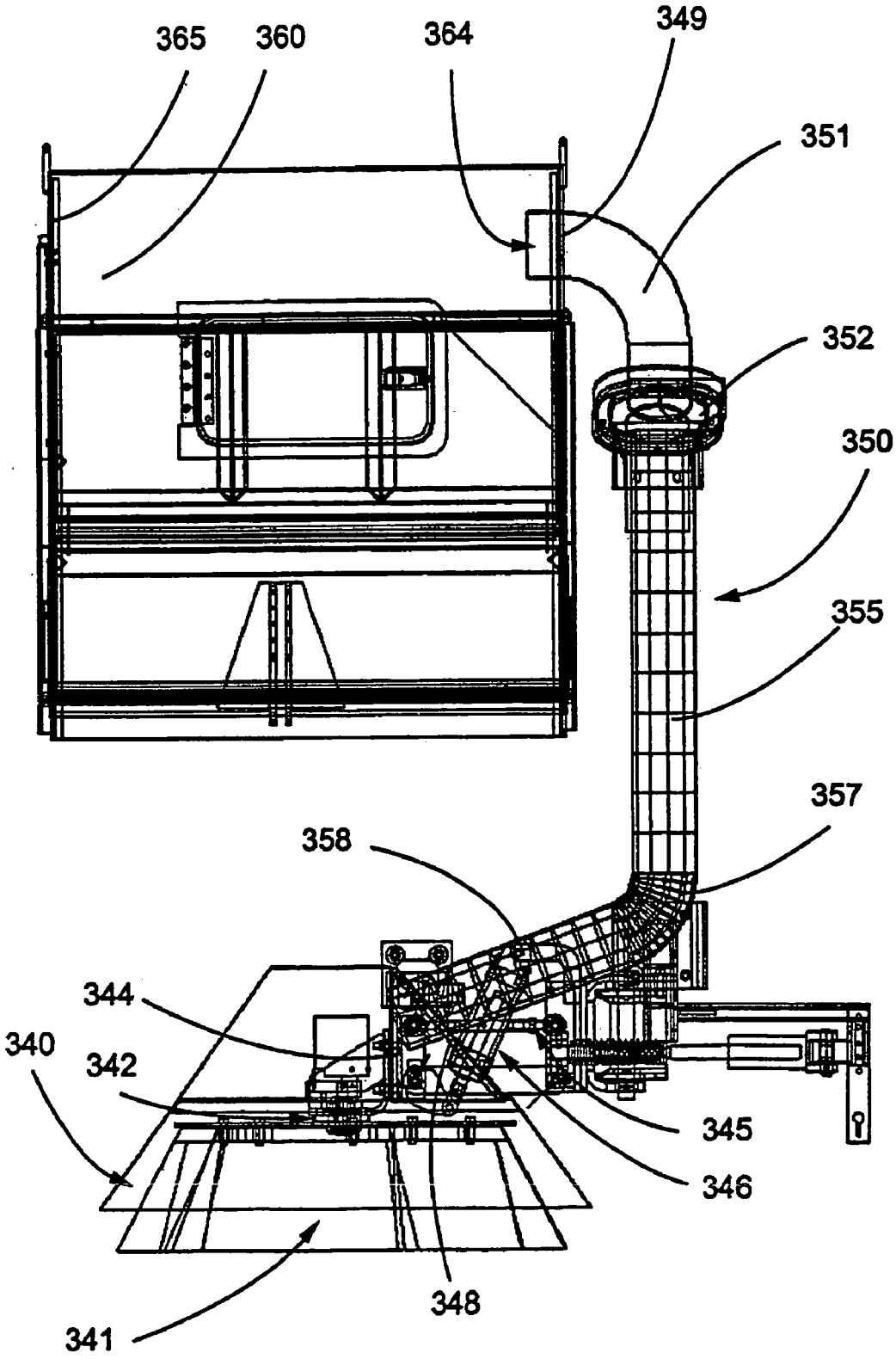
FIG. 9 provides a side partial cutaway view of a vacuum hose, gutter broom, and hopper assembly of the invention.

FIG. 9 provides a partial cutaway view of a preferred gutter broom, vacuum hose, and hopper system of the invention, such as the system incorporated in the exemplary debris collection vehicle shown in FIG. 5B. Such systems are an independent feature of the invention as well as being a preferred element of some of the inventive debris collection vehicles described herein. The gutter broom assembly includes a rotating swivel arm 345 and a height-adjusting arm 346, both of which are mounted to an adjustable central post 344, that also is connected to the motor and axis assembly for the gutter broom 342. The gutter broom 341 is attached to the shaft 342. During operation, the lower portion of the gutter broom extends below the bottom end of the gutter broom shroud 340, by a distance that permits the gutter broom to move heavier debris into the path of the pickup broom (not shown) while lighter debris (dust particulates and the like) rendered airborne by operation of the gutter broom are held down and/or are captured in the gutter broom shroud. The shroud 340 has an opening 348 in which the bottom end portion 358 of the flexible tube assembly is fit during operation. The vacuum suction force, working through the hopper and the fixed vacuum hose draws air through the vacuum hose assembly 350 that ends at a vacuum hose outlet 364, which is positioned slightly inside the inlet 349 to the interior of the top side of the hopper, opposite to the hopper inlet 365 (which receives the majority of the collected debris transported by the conveyor system or other mechanical transport (not shown)).

Figure 10:
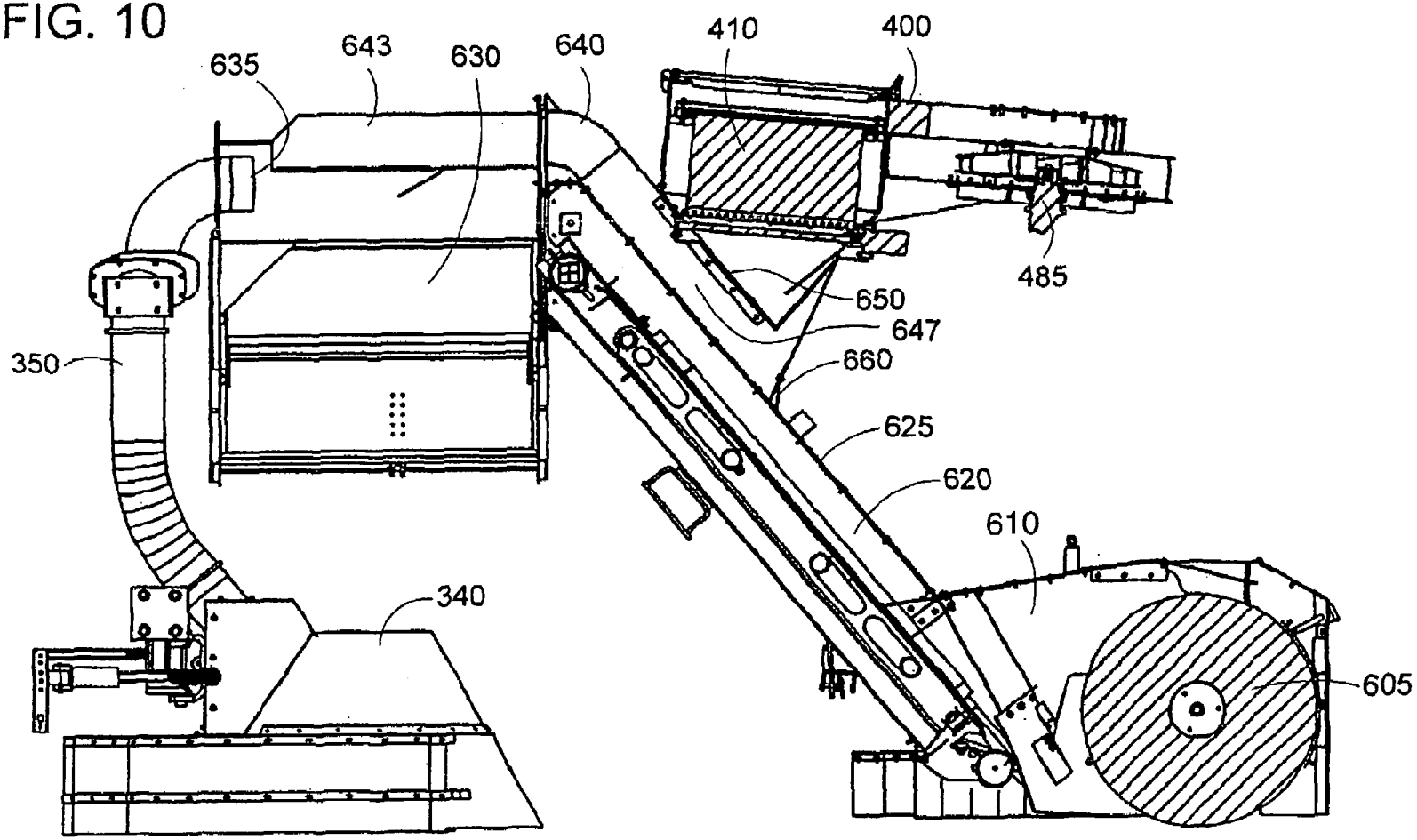
FIG. 10 provides a side cutaway view of the debris collection (or debris contacting) mechanism, debris transport mechanism, storage compartment, filter, and secondary debris collection device components of an alternative exemplary debris collection system of the invention, according to one preferred embodiment.

Other alternative and preferred aspects of the invention can be described with reference to the exemplary debris collection system depicted in FIG. 10. The depicted exemplary debris collection system 600 includes a debris collecting assembly/mechanism 610 comprising a cylindrical debris collecting broom 605; a debris transport mechanism comprising an inclined conveyor belt disposed in a conveyor belt passageway 620; a debris storage tank (or "hopper") 630; a fan and filter assembly 400; and a secondary vacuum hose assembly 350 that is connected to a shrouded debris collection device 340, such as a surface-impacting, rotating broom. These features of these components of the depicted debris collection system can be any suitable components found in other debris collection systems of the invention, examples of which components are discussed elsewhere herein. However, in contrast to other systems described herein, the conveyor passageway 620 in systems such as the depicted system are blocked from direct communication with the interior of the fan and filter housing assembly 400, at any point along the path of the conveyor passageway 620, by the top end of the passageway 625 that acts as a roof or lid on the conveyor passageway, preventing air and airborne debris particles from moving in the direction of the fan and filter assembly 400. The top end of the passageway 625 (which also can be referred to as the roof or lid) desirably is at least essentially impervious to the flow of air and airborne debris particles.

To facilitate the flow of debris-laden air to the filter, such a system includes a top airflow passageway 640, which communicates with the top end of the hopper 630 and the fan and filter housing 400, allowing airflow from the conveyor passageway 620, hopper 630, and other portions of the system to the fan and filter housing 400. Preferably, one end of the top airflow passageway consists of a first airflow tube portion 643 having an open end situated in the hopper (the first portion can be any suitable type of duct, tube, conduit, etc., for the passage of air and debris through and out of the interior of the hopper). The open end of the airflow tube portion is disposed near the topmost interior of the hopper on the side opposite the side where the conveyor belt passageway engages the hopper. The open end can have a smaller diameter than the body of the first portion. The body of the first airflow tube portion extends along the top interior of the hopper towards and through the sidewall where the conveyor feeds collected debris into the hopper. On the outside of this hopper sidewall, the first airflow tube portion 643 bends downward, forming an elbow-shaped section, where the first airflow tube portion 643 engages the second portion 647 of the airflow passageway 640. The second portion 643 and the part of the first airflow tube portion 643 located outside of the hopper are configured such that they connect to and/or rest upon the top end barrier/lid 625 of the conveyor passageway 620 and, accordingly, are disposed in a similar incline as the conveyor passageway and conveyor belt. At the end of the second portion 643, the top airflow passageway communicates with the inlet 650 to the filter and fan housing 400, wherein the filter(s) 410 and fan(s) 485 are located. Optionally, but preferably, at this location, a selectively openable burp plate 660 is positioned in the bottom end of the second portion 643. The burp plate 660, which is shown in a closed configuration in FIG. 10, allows passage of debris through the top airflow passageway 640 to the interior of the conveyor passageway 620 and onto the conveyor belt. Preferably, the burp plate is opened when the filter is purged. In this respect, the operation of the burp plate can either be automatically or manually instigated. In some aspects, the automatic opening of the burp plate can be do to a mechanic or electrical system that coordinates opening of the plate with the operation of an automatic shaker mechanism. In other aspects, the opening of the burp plate is caused by the presence of a physical condition, such as an amount of collected debris, passage of time, or pressure buildup in the system. The features of similar burp plate devices are known to those skilled in the art, although the positioning of such a burp plate in such a debris collection system is believed to be novel.

On the side of the hopper near the open end of the airflow tube portion, the hopper 630 can also engage a secondary vacuum hose debris collection device 350 that can be used to collect debris from a location different from the location where the main broom 605 collects debris. The end of the secondary vacuum hose 635 is positioned in the interior of the hopper 630 near, but below, the location of the open end of the top airflow passageway 640. As such, heavier debris brought into the hopper through the secondary vacuum tube 350 will be collected in the hopper (due to gravitationally falling out of the airflow entering the hopper from the secondary vacuum hose), rather than be transmitted into the top airflow passageway 340.

Figure 11:
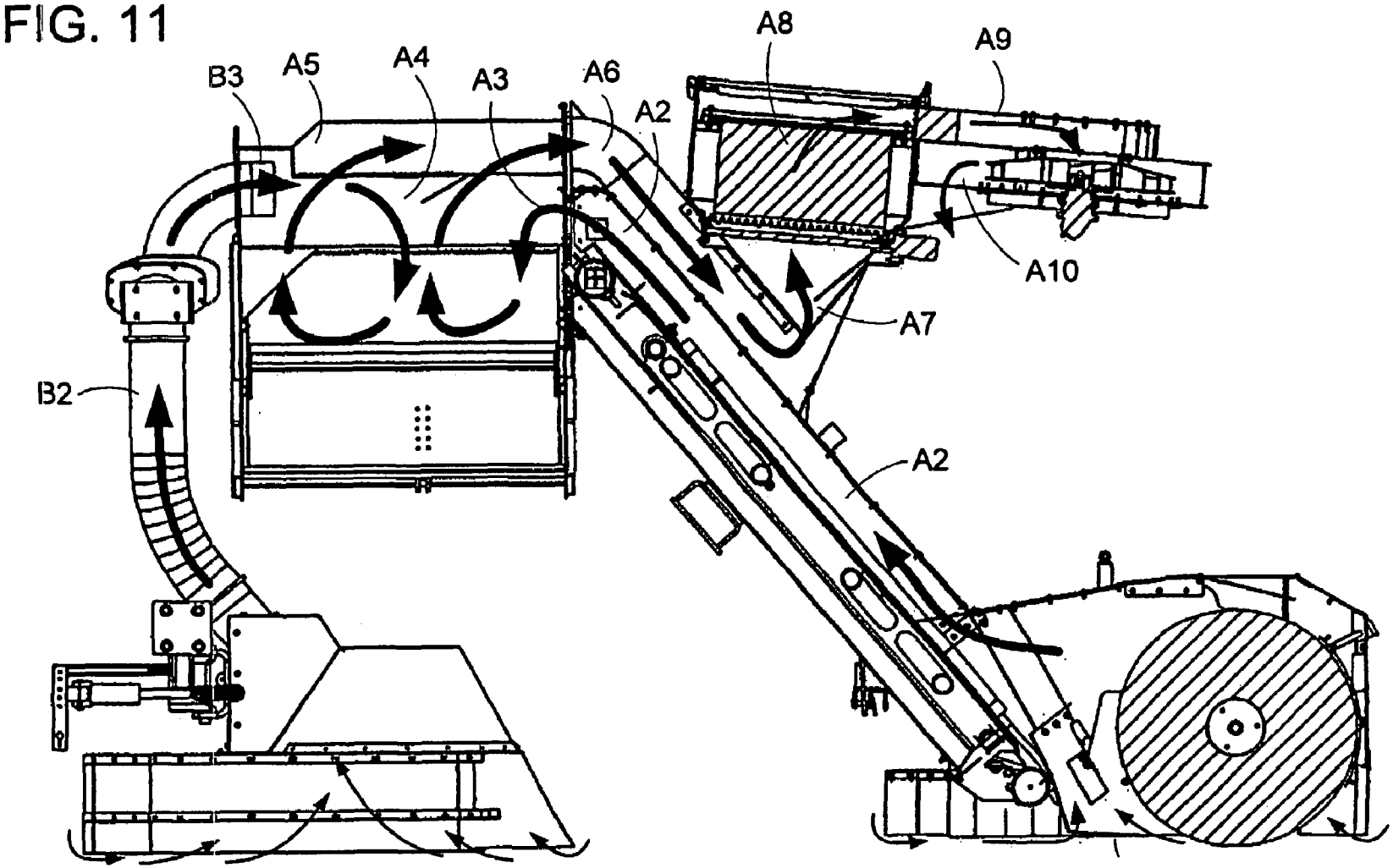
FIG. 11 illustrates the path of airflow through the portion of the debris collection system illustrated in FIG. 10.

The flow of air and debris particles through the system described above with reference to FIG. 10, in operation, is depicted FIG. 11. Most of the debris collected by the system is obtained by the action of the main broom 605 (A1). This debris collection device transmits the debris into the conveyor belt passageway 620 and onto the inclined conveyor belt therein (A2). The debris are transported through the conveyor belt passageway and deposited in the hopper 630 (A3). The sidewalls of the conveyor belt passageway, including the roof or top layer 625, prevent the escape of debris particles moving in the conveyor belt.

Heavier debris released in the hopper immediately settles in the lowest available portion of the hopper, whereas most of the lighter debris also settles out of the airflow due to the length of the hopper (A4). Only relatively very light debris particles enter the top airflow passageway 640 with the airflow passing through the hopper 620 (A5). This airflow passes out of the hopper, in the top airflow passageway (A6), and thereafter to the inlet 650 to the filter and fan assembly 440 (A7). The pressure gradient generated by the operation of the fan(s) 485 draws this air into the assembly such that the airflow is filtered by the filter(s) 410 (A8). The filtered air passes through the fan(s) (A9) and thereafter is released from this portion of the system (A10).

A secondary airflow is created when the secondary vacuum tube debris collection device 350 is engaged, such that debris are collected from a second location in the shrouded debris collection assembly located at the end of the secondary device 340 (B I), transported through the secondary vacuum tube (B2) and are deposited in the hopper 620 on the side opposite the side where the conveyor deposits debris into the hopper and near the top end of the hopper (B3). As discussed above, most of the debris particles in this secondary collected debris settle in the hopper without entering the top airflow passageway. This also is the case for debris entering the system by way of the main debris collection device and conveyor belt.

Although systems having the features of the exemplary systems depicted in and described above with reference to FIGS. 10 and 11 differ from other systems described herein, inasmuch as airflow in the debris transport system of such systems does not directly communicate with the filter housing, the basic benefit of positioning the filter or filters of the system outside of and isolated from the hopper are maintained. Such systems, however, offer the additional advantageous benefit that airflow must flow through the hopper (the volume of which functionally acts as a tortuous path), and through the tortuous path formed by the top airflow passageway, before such airflow reaches the filter housing (wherein an additional tortuous path may be formed as described elsewhere herein). As such, air contacting the filter or filters in such a system can be even cleaner than that of other systems of the invention. Accordingly, the useful filter life in such systems can be increased.

In addition to providing novel alternatives to the debris collection systems, vehicles, and methods of debris collection known in the art, the systems, vehicles, and methods of the invention generally offer several advantageous performance characteristics not attendant such prior art vehicles, systems, and methods. For example, the separate placement of the filter housing and storage compartment reduces the amount of debris loading in the filter, thereby increasing the life of the filter and the effectiveness of the system. The design of the system and debris collection vehicle of the invention also provides a more efficient use of the storage compartment, as the ratio of debris above about 100 microns or more in size in the storage compartment is significantly increased over debris collection/handling systems and vehicles previously known in the art. Additionally, the placement of the filter in a separate and accessible filter housing is advantageous in allowing easier servicing and/or replacement of the filter than in systems and vehicles where the filter is housed in the storage compartment or upstream of it. Another beneficial aspect of the systems, devices, and vehicles of the invention is the ability to limit the dispersion of airborne particles, such as particles rendered airborne by the operation of a debris contacting mechanism, particularly by collecting such particles that would otherwise be dispersed into the environment without the operation of the debris collection system or device.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") and encompassing the terms "consisting essentially of" and "consisting of" unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law.

What is claimed is:

1. A debris collection device for collecting debris with limited dispersion of airborne particles comprising:

(a) a vehicle including a plurality of wheels, at least one of said plurality being maneuverable by operation of a selectively operable steering mechanism and at least one wheel of said plurality providing propulsion to said vehicle;

(b) a debris storage compartment;

(c) a collecting mechanism that contacts debris and moves said debris away from a surface that is to be cleaned in a direction substantially the same as the direction of forward movement of the vehicle;

(d) a transport mechanism including a first inlet located proximal to said collecting mechanism, said transport mechanism being configured to receive debris at said first inlet and move said debris towards said storage compartment where at least a portion of said debris are deposited;

(e) a filter and vacuum assembly disposed downstream of the first inlet relative to the path of transported debris and being physically separated from said storage compartment, said filter and vacuum assembly including a second inlet, a vacuum-generating component, and at least one filter;

(f) an airflow passageway comprising first and second ends, said first end being located in said storage compartment near the side opposite where said transport mechanism engages said storage compartment and said second end of said airflow passageway being in communication with said second inlet;

wherein operation of said vacuum-generating component produces a primary airflow that draws airborne particles into said first inlet, along a path proximate to said debris transport mechanism, and wherein said debris collection device is configured such that debris-laden air must travel across most of the storage compartment before entering said first end of said airflow passageway and substantially all primary airflow must pass through said airflow passageway before entering said second inlet of said filter and vacuum assembly and contacting said filter.

2. The debris collection device of claim 1, wherein said debris collection device includes a shaking mechanism operably connected to said at least one filter, said shaking mechanism being configured such that, upon operation, debris is released from said at least one filter and thereafter falls under gravity through said second inlet and said filter and vacuum assembly into contact with said transport mechanism, whereupon said transport mechanism carries said released debris to said storage compartment.

3. The debris collection device of claim 2, wherein said shaking mechanism is automatically operable.

4. The debris collection device of claim 3, wherein automatic operation of said shaking mechanism occurs in response to air pressure in said filter and vacuum assembly reaching or exceeding a predetermined air pressure level.

5. The debris collection device of claim 1, wherein said device is configured such that said primary airflow travels a tortuous flow path between said second inlet and said filter.

6. The debris collection device of claim 1, wherein said transport mechanism is deposed on an incline and configured so that debris received through said first inlet contact said transport mechanism in a manner such that gravity and friction maintain at least a substantial portion of said debris in contact with said transport mechanism until said portion is deposited in said storage compartment.

7. The debris collection device of claim 1, wherein said transport mechanism is deposed upon an incline and configured so that debris received through said first inlet contact said transport mechanism in a manner such that gravity and friction maintain said debris in contact with said transport mechanism at least long enough for a cleat or scoop to contact and move said debris towards said storage compartment.

8. The debris collection device of claim 1, wherein said device is configured such that less than about 10% of the debris entering said transport systems enter said filter and vacuum assembly.

9. The debris collection device of claim 1, wherein said debris collection device further includes a portable collection device connected to and in communication with said storage compartment, the use of said portable collection device generating a secondary airflow that delivers airborne particles through said portable collection device and into said storage compartment, where the force of said secondary airflow is significantly less than the force of said primary airflow.

10. The debris collection device of claim 1, wherein the debris collection device further comprises at least one peripheral broom and a secondary vacuum hose assembly, the secondary vacuum hose assembly establishing airflow communication between the peripheral broom and the debris storage compartment.

* * * * *